US010999693B2

(12) United States Patent
Kim et al.

(10) Patent No.: US 10,999,693 B2
(45) Date of Patent: May 4, 2021

(54) RENDERING DIFFERENT PORTIONS OF AUDIO DATA USING DIFFERENT RENDERERS

(71) Applicant: QUALCOMM Incorporated, San Diego, CA (US)

(72) Inventors: Moo Young Kim, San Diego, CA (US); Ferdinando Olivieri, San Diego, CA (US); Dipanjan Sen, Dublin, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 16/450,660

(22) Filed: Jun. 24, 2019

(65) Prior Publication Data

US 2019/0394605 A1 Dec. 26, 2019

Related U.S. Application Data

(60) Provisional application No. 62/689,605, filed on Jun. 25, 2018.

(51) Int. Cl.
*H04S 3/00* (2006.01)
*H04S 7/00* (2006.01)
(Continued)

(52) U.S. Cl.
CPC ..... *H04S 7/303* (2013.01); *G10L 19/008* (2013.01); *G10L 19/167* (2013.01); *H04R 5/02* (2013.01);
(Continued)

(58) Field of Classification Search
CPC ..... H04S 7/304; H04S 7/306; H04S 7/303; H04S 7/30; H04S 2400/15; H04S 2420/11; H04S 2400/01; H04S 2400/11
(Continued)

(56) References Cited

U.S. PATENT DOCUMENTS 9,489,955 B2 11/2016 Peters et al.
9,502,044 B2 11/2016 Peters et al.
9,609,452 B2 3/2017 Peters et al.
(Continued)

FOREIGN PATENT DOCUMENTS

WO 2015184307 A1 12/2015

OTHER PUBLICATIONS

ETSI TS 103 589 V1.1.1, "Higher Order Ambisonics (HOA) Transport Format", Jun. 2018, 33 pages.
(Continued)

*Primary Examiner* — Disler Paul
(74) *Attorney, Agent, or Firm* — Shumaker & Sieffert, P.A.

(57) ABSTRACT

In general, techniques are described by which to render different portions of audio data using different renderers. A device comprising a memory and one or more processors may be configured to perform the techniques. The memory may store audio renderers. The processor(s) may obtain a first audio renderer of the plurality of audio renderers, and apply the first audio renderer with respect to a first portion of the audio data to obtain one or more first speaker feeds. The processor(s) may next obtain a second audio renderer of the plurality of audio renderers, and apply the second audio renderer with respect to a second portion of the audio data to obtain one or more second speaker feeds. The processor(s) may output, to one or more speakers, the one or more first speaker feeds and the one or more second speaker feeds.

29 Claims, 13 Drawing Sheets

(51) Int. Cl.

| | |
|---|---|
| ***H04R 5/02*** | (2006.01) |
| ***G10L 19/008*** | (2013.01) |
| ***G10L 19/16*** | (2013.01) |
| ***H04S 3/02*** | (2006.01) |

(52) U.S. Cl.
CPC ..... *H04S 3/008* (2013.01); *H04S 3/02* (2013.01); *H04S 2400/01* (2013.01); *H04S 2400/03* (2013.01); *H04S 2400/11* (2013.01); *H04S 2420/11* (2013.01)

(58) Field of Classification Search
USPC ..... 381/22–23
See application file for complete search history.

(56) References Cited

U.S. PATENT DOCUMENTS

| | | | | |
|---|---|---|---|---|
| 9,870,778 | B2 | 1/2018 | Peters et al. | |
| 9,883,310 | B2 | 1/2018 | Peters et al. | |
| 9,961,467 | B2 | 5/2018 | Kim et al. | |
| 9,961,475 | B2 | 5/2018 | Kim et al. | |
| 10,075,802 | B1 * | 9/2018 | Kim | G10L 25/21 |
| 10,178,489 | B2 * | 1/2019 | Sen | G10L 19/167 |
| 10,249,312 | B2 | 4/2019 | Kim et al. | |
| 2011/0249821 | A1 | 10/2011 | Jaillet et al. | |
| 2016/0066118 | A1 * | 3/2016 | Oh | H04S 3/008 381/303 |
| 2016/0133263 | A1 * | 5/2016 | Borss | H04S 3/008 381/22 |
| 2016/0212559 | A1 * | 7/2016 | Mateos Sole | H04S 7/30 |
| 2017/0171682 | A1 * | 6/2017 | Boehm | H04S 3/02 |
| 2017/0180902 | A1 * | 6/2017 | Kordon | H04S 3/008 |
| 2017/0180905 | A1 * | 6/2017 | Purnhagen | G10L 19/008 |
| 2017/0188174 | A1 * | 6/2017 | Lee | H04S 7/307 |
| 2018/0068664 | A1 * | 3/2018 | Seo | H04S 7/302 |
| 2018/0359294 | A1 * | 12/2018 | Brown | H04L 65/403 |
| 2019/0139554 | A1 * | 5/2019 | Sun | H04S 1/005 |

OTHER PUBLICATIONS

Hellerud E., et al., "Encoding Higher Order Ambisonics with AAC", Audio Engineering Society—124th Audio Engineering Society Convention 2008, AES, 60 East 42nd Street, Room 2520, New York 10165-2520, USA, May 1, 2008, pp. 1-8, XP040508582, abstract, figure 1.

Herre, et al., "MPEG-H 3D Audio—The New Standard for Coding of Immersive Spatial Audio," IEEE Journal of Selected Topics in Signal Processing, vol. 9, No. 5, Aug. 2015, pp. 770-779.

Hollerweger F., "An Introduction to Higher Order Ambisonic," Oct. 2008, pp. 13, Accessed online [Jul. 8, 2013] at <URL: flo.mur.at/writings/HOA-intro.pdf>.

"Information technology—High Efficiency Coding and Media Delivery in Heterogeneous Environments—Part 3: 3D Audio," ISO/IEC JTC 1/SC 29/WG11, ISO/IEC 23008-3, 201x(E), Oct. 12, 2016, 797 Pages.

"Information technology—High efficiency coding and media delivery in heterogeneous environments—Part 3: Part 3: 3D Audio, Amendment 3: MPEG-H 3D Audio Phase 2," ISO/IEC JTC 1/SC 29N, ISO/IEC 23008-3:2015/PDAM 3, Jul. 25, 2015, 208 pp.

"Information technology—High efficiency coding and media delivery in heterogeneous environments—Part 3: 3D Audio," ISO/IEC JTC 1/SC 29N, Apr. 4, 2014, 337 pp.

ISO/IEC DIS 23008-3 Information Technology—High Efficiency coding and media delivery in heterogeneous environments—Part 3: 3D audio, Jul. 25, 2014 (Jul. 25, 2014), XP055205625, Retrieved from the Internet URL: http://mpeg.chiariglione.org/standards/mpeg-h/3d-audio/dis-mpeg-h-3d-audio [retrieved on Jul. 30, 2015], 433 pages.

Poletti M., "Three-Dimensional Surround Sound Systems Based on Spherical Harmonics," The Journal of the Audio Engineering Society, vol. 53, No. 11, Nov. 2005, pp. 1004-1025.

Schonefeld V., "Spherical Harmonics," Jul. 1, 2005, XP002599101, 25 Pages, Accessed online [Jul. 9, 2013] at URL:http://videoarch1.s-inf.de/~volker/prosem_paper.pdf.

Sen D., et al., "RMI-HOA Working Draft Text", 107. MPEG Meeting; Jan. 13, 2014-Jan. 17, 2014; San Jose; (Motion Picture Expert Group or ISO/IEC JTC1/SC29/WG11), No. m31827, Jan. 11, 2014 (Jan. 11, 2014), 83 Pages, XP030060280.

Sen D., et al., "Technical Description of the Qualcomm's HoA Coding Technology for Phase II", 109. MPEG Meeting; Jul. 7, 2014-Jul. 11, 2014; Sapporo; (Motion Picture Expert Group or ISO/IEC JTC1/SC29/WG11), No. m34104, Jul. 2, 2014 (Jul. 2, 2014), XP030062477, figure 1.

International Search Report and Written Opinion—PCT/US2019/039025—ISA/EPO—dated Nov. 15, 2019.

* cited by examiner

RENDERING DIFFERENT PORTIONS OF AUDIO DATA USING DIFFERENT RENDERERS

This application claims the benefit of U.S. Provisional Application Ser. No. 62/689,605, filed Jun. 25, 2018, the entire contents of each being incorporated by reference as if set forth in their entirety herein.

TECHNICAL FIELD

This disclosure relates to audio data and, more specifically, rendering of audio data.

BACKGROUND

A higher order ambisonic (HOA) signal (often represented by a plurality of spherical harmonic coefficients (SHC) or other hierarchical elements) is a three-dimensional (3D) representation of a soundfield. The HOA representation may represent this soundfield in a manner that is independent of the local speaker geometry used to playback a multi-channel audio signal rendered from this HOA signal. The HOA signal may also facilitate backwards compatibility as the HOA signal may be rendered to well-known and highly adopted multi-channel formats, such as a 5.1 audio channel format or a 7.1 audio channel format. The HOA representation may therefore enable a better representation of a soundfield that also accommodates backward compatibility.

SUMMARY

In general, techniques are described for rendering different portions of higher order ambisonic (HOA) audio data using different renderers. Rather than utilize a single renderer to render all of the various portions of the HOA audio data, the audio encoder may associate different portions of the HOA audio data with different audio renderers. In one example, the different portions may refer to different transport channels of a bitstream representative of a compressed version of the HOA audio data.

Specifying different renderers with respect to different transport channels may allow for less error as application of a single renderer may better render certain transport channels compared to other transport channels, and thereby increase an amount of error that occurs during playback, injecting audio artifacts that may decrease perceived quality. In this respect, the techniques may improve perceived audio quality, resulting in more accurate audio reproduction, improving the operation of the audio encoders and the audio decoders themselves.

In one example, various aspects of the techniques are directed to a device configured to render audio data representative of a soundfield, the device comprising: one or more memories configured to store a plurality of audio renderers; one or more processors configured to: obtain a first audio renderer of the plurality of audio renderers; apply the first audio renderer with respect to a first portion of the audio data to obtain one or more first speaker feeds; obtain a second audio renderer of the plurality of audio renderers; apply the second audio renderer with respect to a second portion of the audio data to obtain one or more second speaker feeds; and output, to one or more speakers, the one or more first speaker feeds and the one or more second speaker feeds.

In another example, various aspects of the techniques are directed to a method of rendering audio data representative of a soundfield, the device comprising: obtaining a first audio renderer of a plurality of audio renderers; applying the first audio renderer with respect to a first portion of the audio data to obtain one or more first speaker feeds; obtaining a second audio renderer of the plurality of audio renderers; applying the second audio renderer with respect to a second portion of the audio data to obtain one or more second speaker feeds; and outputting, to one or more speakers, the one or more first speaker feeds and the one or more second speaker feeds.

In another example, various aspects of the techniques are directed to a device configured to render audio data representative of a soundfield, the device comprising: means for obtaining a first audio renderer of a plurality of audio renderers; means for applying the first audio renderer with respect to a first portion of the audio data to obtain one or more first speaker feeds; means for obtaining a second audio renderer of the plurality of audio renderers; means for applying the second audio renderer with respect to a second portion of the audio data to obtain one or more second speaker feeds; and means for outputting, to one or more speakers, the one or more first speaker feeds and the one or more second speaker feeds.

In another example, various aspects of the techniques are directed to a non-transitory computer-readable storage medium has stored thereon instructions that, when executed, cause one or more processors to obtain a first audio renderer of a plurality of audio renderers; apply the first audio renderer with respect to a first portion of audio data to obtain one or more first speaker feeds; obtain a second audio renderer of the plurality of audio renderers; apply the second audio renderer with respect to a second portion of the audio data to obtain one or more second speaker feeds; and output, to one or more speakers, the one or more first speaker feeds and the one or more second speaker feeds.

In another example, various aspects of the techniques are directed to a device configured to obtain a bitstream representative of audio data describing a soundfield, the device comprising: one or more memories configured to store the audio data; one or more processors configured to: specify, in the bitstream, a first indication identifying a first audio renderer of a plurality of audio renderers to be applied to a first portion of the audio data; specify, in the bitstream, the first portion of the audio data; specify, in the bitstream, a second indication identifying a second audio renderer of the plurality of audio renderers to be applied to a second portion of the audio data; specify, in the bitstream, the second portion of the audio data; and output the bitstream.

In another example, various aspects of the techniques are directed to a method of obtaining a bitstream representative of audio data describing a soundfield, the device comprising: specifying, in the bitstream, a first indication identifying a first audio renderer of a plurality of audio renderers to be applied to a first portion of the audio data; specifying, in the bitstream, the first portion of the audio data; specifying, in the bitstream, a second indication identifying a second audio renderer of the plurality of audio renderers to be applied to a second portion of the audio data; specifying, in the bitstream, the second portion of the audio data; and outputting the bitstream.

In another example, various aspects of the techniques are directed to a device configured to obtain a bitstream representative of audio data describing a soundfield, the device comprising: means for specifying, in the bitstream, a first indication identifying a first audio renderer of a plurality of audio renderers to be applied to a first portion of the audio data; means for specifying, in the bitstream, the first portion of the audio data; means for specifying, in the bitstream, a second indication identifying a second audio renderer of the plurality of audio renderers to be applied to a second portion of the audio data; means for specifying, in the bitstream, the second portion of the audio data; and means for outputting the bitstream.

In another example, various aspects of the techniques are directed to a non-transitory computer-readable storage medium has stored thereon instructions that, when executed, cause one or more processors to specify, in a bitstream representative of a compressed version of audio data describing a soundfield, a first indication identifying a first audio renderer of a plurality of audio renderers to be applied to a first portion of the audio data; specify, in the bitstream, the first portion of the audio data; specify, in the bitstream, a second indication identifying a second audio renderer of the plurality of audio renderers to be applied to a second portion of the audio data; specify, in the bitstream, the second portion of the audio data; and output the bitstream.

The details of one or more aspects of the techniques are set forth in the accompanying drawings and the description below. Other features, objects, and advantages of these techniques will be apparent from the description and drawings, and from the claims.

DETAILED DESCRIPTION

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. A Moving Pictures Expert Group (MPEG) has released a standard allowing for soundfields to be represented using a hierarchical set of elements (e.g., Higher-Order Ambisonic—HOA—coefficients) that can be rendered to speaker feeds for most speaker configurations, including 5.1 and 22.2 configuration whether in location defined by various standards or in non-uniform locations.

MPEG released the standard as MPEG-H 3D Audio standard, formally entitled "Information technology—High efficiency coding and media delivery in heterogeneous environments—Part 3: 3D audio," set forth by ISO/IEC JTC 1/SC 29, with document identifier ISO/IEC DIS 23008-3, and dated Jul. 25, 2014. MPEG also released a second edition of the 3D Audio standard, entitled "Information technology—High efficiency coding and media delivery in heterogeneous environments—Part 3: 3D audio, set forth by ISO/IEC JTC 1/SC 29, with document identifier ISO/IEC 23008-3:201x(E), and dated Oct. 12, 2016. Reference to the "3D Audio standard" in this disclosure may refer to one or both of the above standards.

As noted above, one example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here, $$k = \frac{\omega}{c},$$

the speed of sound (~343 m/s), $\{r_r, \theta_r, \varphi_r\}$ is a point of reference (or observation point), $j_n(\cdot)$ is the spherical Bessel function of order n, and $Y_m^m(\theta_r, \varphi_r)$ are the spherical harmonic basis functions (which may also be referred to as a spherical basis function) of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

Figure 1:
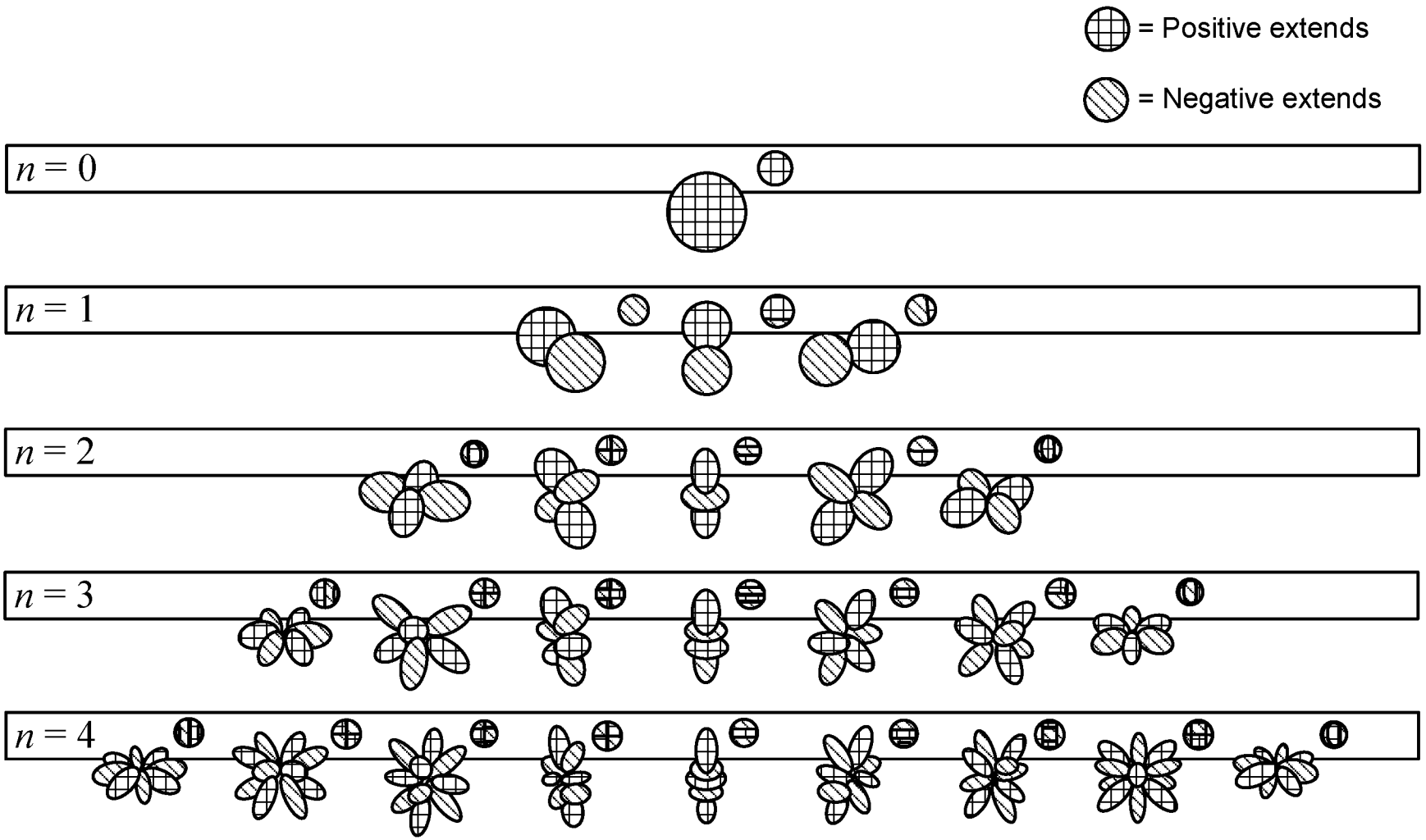
FIG. 1 is a diagram illustrating spherical harmonic basis functions of various orders and sub-orders.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC (which also may be referred to as higher order ambisonic—HOA—coefficients) represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\varphi_s),$$

where i is $\sqrt{-1}$, $h_n^{(2)}(\cdot)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a number of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \varphi_r\}$. The remaining figures are described below in the context of SHC-based audio coding.

Figure 2:
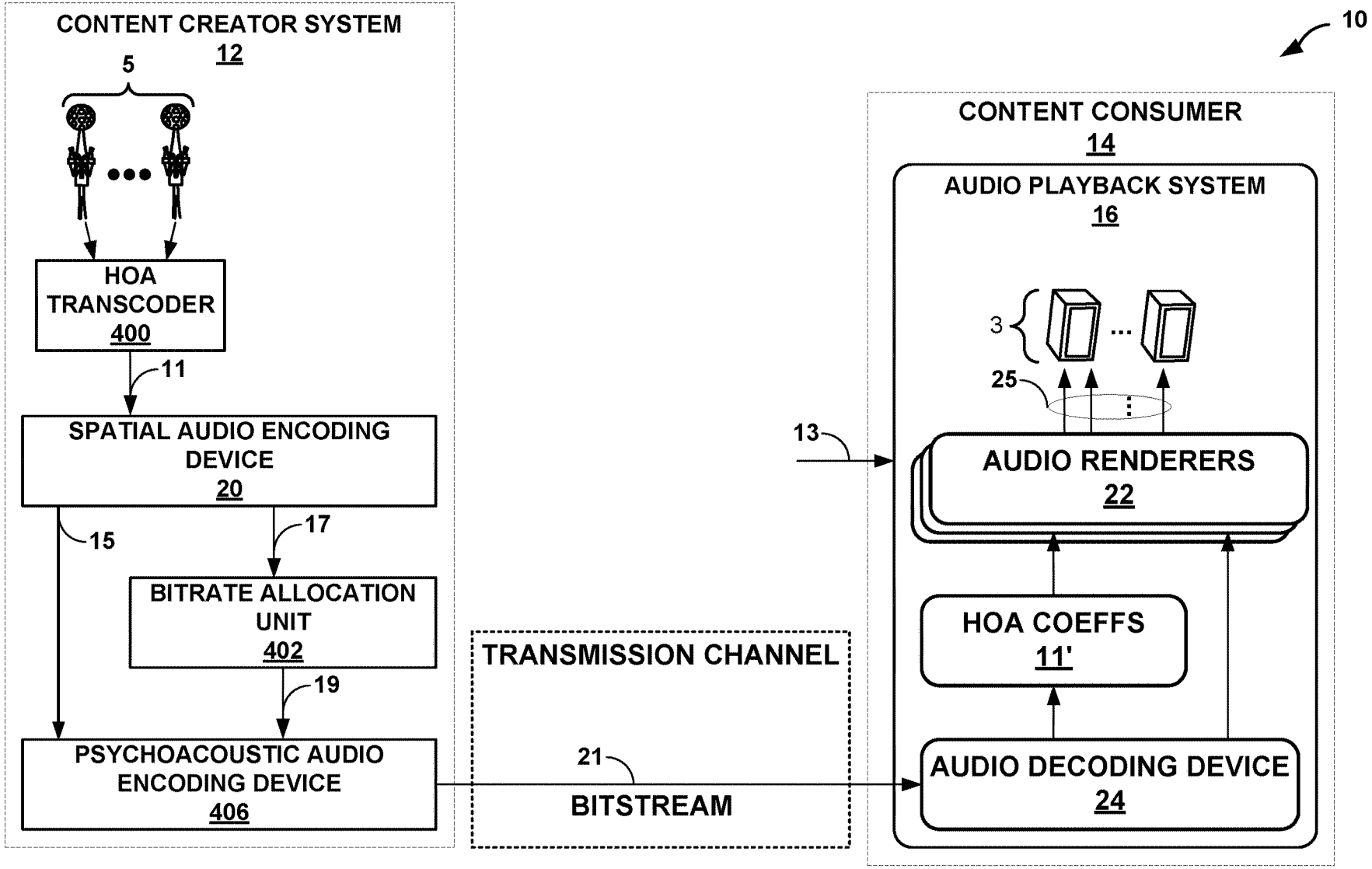
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator system 12 and a content consumer 14. While described in the context of the content creator system 12 and the content consumer 14, the techniques may be implemented in any context in which SHCs (which may also be referred to as HOA coefficients) or any other hierarchical representation of a soundfield are encoded to form a bitstream representative of the audio data. Moreover, the content creator system 12 may represent a system comprising one or more of any form of computing devices capable of implementing the techniques described in this disclosure, including a handset (or cellular phone, including a so-called "smart phone"), a tablet computer, a laptop computer, a desktop computer, or dedicated hardware to provide a few examples or. Likewise, the content consumer 14 may represent any form of computing device capable of implementing the techniques described in this disclosure, including a handset (or cellular phone, including a so-called "smart phone"), a tablet computer, a television, a set-top box, a laptop computer, a gaming system or console, or a desktop computer to provide a few examples.

The content creator network 12 may represent any entity that may generate multi-channel audio content and possibly video content for consumption by content consumers, such as the content consumer 14. The content creator system 12 may capture live audio data at events, such as sporting events, while also inserting various other types of additional audio data, such as commentary audio data, commercial audio data, intro or exit audio data and the like, into the live audio content.

The content consumer 14 represents an individual that owns or has access to an audio playback system, which may refer to any form of audio playback system capable of rendering higher order ambisonic audio data (which includes higher order audio coefficients that, again, may also be referred to as spherical harmonic coefficients) to speaker feeds for play back as so-called "multi-channel audio content." The higher-order ambisonic audio data may be defined in the spherical harmonic domain and rendered or otherwise transformed from the spherical harmonic domain to a spatial domain, resulting in the multi-channel audio content in the form of one or more speaker feeds. In the example of FIG. 2, the content consumer 14 includes an audio playback system 16.

The content creator system 12 includes microphones 5 that record or otherwise obtain live recordings in various formats (including directly as HOA coefficients and audio objects). When the microphone array 5 (which may also be referred to as "microphones 5") obtains live audio directly as HOA coefficients, the microphones 5 may include an HOA transcoder, such as an HOA transcoder 400 shown in the example of FIG. 2.

In other words, although shown as separate from the microphones 5, a separate instance of the HOA transcoder 400 may be included within each of the microphones 5 so as to naturally transcode the captured feeds into the HOA coefficients 11. However, when not included within the microphones 5, the HOA transcoder 400 may transcode the live feeds output from the microphones 5 into the HOA coefficients 11. In this respect, the HOA transcoder 400 may represent a unit configured to transcode microphone feeds and/or audio objects into the HOA coefficients 11. The content creator system 12 therefore includes the HOA transcoder 400 as integrated with the microphones 5, as an HOA transcoder separate from the microphones 5 or some combination thereof.

The content creator system 12 may also include a spatial audio encoding device 20, a bitrate allocation unit 402, and a psychoacoustic audio encoding device 406. The spatial audio encoding device 20 may represent a device capable of performing the compression techniques described in this disclosure with respect to the HOA coefficients 11 to obtain intermediately formatted audio data 15 (which may also be referred to as "mezzanine formatted audio data 15" when the content creator system 12 represents a broadcast network as described in more detail below). Intermediately formatted audio data 15 may represent audio data that is compressed using the spatial audio compression techniques but that has not yet undergone psychoacoustic audio encoding (e.g., such as advanced audio coding—AAC, or other similar types of psychoacoustic audio encoding, including various enhanced AAC—eAAC—such as high efficiency AAC—HE-AAC—HE-AAC v2, which is also known as eAAC+, etc.). Although described in more detail below, the spatial audio encoding device 20 may be configured to perform this intermediate compression with respect to the HOA coefficients 11 by performing, at least in part, a decomposition (such as a linear decomposition described in more detail below) with respect to the HOA coefficients 11.

The spatial audio encoding device 20 may be configured to compress the HOA coefficients 11 using a decomposition involving application of a linear invertible transform (LIT). One example of the linear invertible transform is referred to as a "singular value decomposition" (or "SVD"), which may represent one form of a linear decomposition. In this example, the spatial audio encoding device 20 may apply SVD to the HOA coefficients 11 to determine a decomposed version of the HOA coefficients 11. The decomposed version of the HOA coefficients 11 may include one or more of predominant audio signals and one or more corresponding spatial components describing a direction, shape, and width of the associated predominant audio signals. The spatial audio encoding device 20 may analyze the decomposed version of the HOA coefficients 11 to identify various parameters, which may facilitate reordering of the decomposed version of the HOA coefficients 11.

The spatial audio encoding device 20 may reorder the decomposed version of the HOA coefficients 11 based on the identified parameters, where such reordering, as described in further detail below, may improve coding efficiency given that the transformation may reorder the HOA coefficients across frames of the HOA coefficients (where a frame commonly includes M samples of the decomposed version of the HOA coefficients 11 and M is, in some examples, set to 1024). After reordering the decomposed version of the HOA coefficients 11, the spatial audio encoding device 20 may select those of the decomposed version of the HOA coefficients 11 representative of foreground (or, in other words, distinct, predominant or salient) components of the soundfield. The spatial audio encoding device 20 may specify the decomposed version of the HOA coefficients 11 representative of the foreground components as an audio object (which may also be referred to as a "predominant sound signal," or a "predominant sound component") and associated directional information (which may also be referred to as a "spatial component" or, in some instances, as a so-called "V-vector").

The spatial audio encoding device 20 may next perform a soundfield analysis with respect to the HOA coefficients 11 in order to, at least in part, identify the HOA coefficients 11 representative of one or more background (or, in other words, ambient) components of the soundfield. The spatial audio encoding device 20 may perform energy compensation with respect to the background components given that, in some examples, the background components may only include a subset of any given sample of the HOA coefficients 11 (e.g., such as those corresponding to zero and first order spherical basis functions and not those corresponding to second or higher order spherical basis functions). When order-reduction is performed, in other words, the spatial audio encoding device 20 may augment (e.g., add/subtract energy to/from) the remaining background HOA coefficients of the HOA coefficients 11 to compensate for the change in overall energy that results from performing the order reduction.

The spatial audio encoding device 20 may perform a form of interpolation with respect to the foreground directional information and then perform an order reduction with respect to the interpolated foreground directional information to generate order reduced foreground directional information. The spatial audio encoding device 20 may further perform, in some examples, a quantization with respect to the order reduced foreground directional information, outputting coded foreground directional information. In some instances, this quantization may comprise a scalar/entropy quantization. The spatial audio encoding device 20 may then output the intermediately formatted audio data 15 as the background components, the foreground audio objects, and the quantized directional information.

The background components and the foreground audio objects may comprise pulse code modulated (PCM) transport channels in some examples. That is, the spatial audio encoding device 20 may output a transport channel for each frame of the HOA coefficients 11 that includes a respective one of the background components (e.g., M samples of one of the HOA coefficients 11 corresponding to the zero or first order spherical basis function) and for each frame of the foreground audio objects (e.g., M samples of the audio objects decomposed from the HOA coefficients 11). The spatial audio encoding device 20 may further output side information (which may also be referred to as "sideband information") that includes the spatial components corresponding to each of the foreground audio objects. Collectively, the transport channels and the side information may be represented in the example of FIG. 1 as the intermediately formatted audio data 15. In other words, the intermediately formatted audio data 15 may include the transport channels and the side information.

The spatial audio encoding device 20 may then transmit or otherwise output the intermediately formatted audio data 15 to psychoacoustic audio encoding device 406. The psychoacoustic audio encoding device 406 may perform psychoacoustic audio encoding with respect to the intermediately formatted audio data 15 to generate a bitstream 21. The content creator system 12 may then transmit the bitstream 21 via a transmission channel to the content consumer 14.

In some examples, the psychoacoustic audio encoding device 406 may represent multiple instances of a psychoacoustic audio coder, each of which is used to encode a transport channel of the intermediately formatted audio data 15. In some instances, this psychoacoustic audio encoding device 406 may represent one or more instances of an advanced audio coding (AAC) encoding unit. The psychoacoustic audio coder unit 406 may, in some instances, invoke an instance of an AAC encoding unit for each transport channel of the intermediately formatted audio data 15.

More information regarding how the background spherical harmonic coefficients may be encoded using an AAC encoding unit can be found in a convention paper by Eric Hellerud, et al., entitled "Encoding Higher Order Ambisonics with AAC," presented at the 124$^{th}$ Convention, 2008 May 17-20 and available at: http://ro.uow.edu.au/cgi/viewcontent.cgi?article=8025&context=engpapers. In some instances, the psychoacoustic audio encoding device 406 may audio encode various transport channels (e.g., transport channels for the background HOA coefficients) of the intermediately formatted audio data 15 using a lower target bitrate than that used to encode other transport channels (e.g., transport channels for the foreground audio objects) of the intermediately formatted audio data 15.

While shown in FIG. 2 as being directly transmitted to the content consumer 14, the content creator system 12 may output the bitstream 21 to an intermediate device positioned between the content creator system 12 and the content consumer 14. The intermediate device may store the bitstream 21 for later delivery to the content consumer 14, which may request this bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer 14, requesting the bitstream 21.

Alternatively, the content creator system 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to those channels by which content stored to these mediums are transmitted (and may include retail stores and other store-based delivery mechanism). In any event, the techniques of this disclosure should not therefore be limited in this respect to the example of FIG. 2.

As further shown in the example of FIG. 2, the content consumer 14 includes the audio playback system 16. The audio playback system 16 may represent any audio playback system capable of playing back multi-channel audio data. The audio playback system 16 may include a number of different audio renderers 22. The audio renderers 22 may each provide for a different form of rendering, where the different forms of rendering may include one or more of the various ways of performing vector-base amplitude panning (VBAP), and/or one or more of the various ways of performing soundfield synthesis.

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel.

That is, the audio decoding device 24 may dequantize the foreground directional information specified in the bitstream 21, while also performing psychoacoustic decoding with respect to the foreground audio objects specified in the bitstream 21 and the encoded HOA coefficients representative of background components. The audio decoding device 24 may further perform interpolation with respect to the decoded foreground directional information and then determine the HOA coefficients representative of the foreground components based on the decoded foreground audio objects and the interpolated foreground directional information. The audio decoding device 24 may then determine the HOA coefficients 11' based on the determined HOA coefficients representative of the foreground components and the decoded HOA coefficients representative of the background components.

The audio playback system 16 may, after decoding the bitstream 21 to obtain the HOA coefficients 11', render the HOA coefficients 11' to output speaker feeds 25. The audio playback system 16 may output speaker feeds 25 to one or more of speakers 3. The speaker feeds 25 may drive the speakers 3. The speakers 3 may represent loudspeakers (e.g., transducers placed in a cabinet or other housing), headphone speakers, or any other type of transducer capable of emitting sounds based on electrical signals.

To select the appropriate renderer or, in some instances, generate an appropriate renderer, the audio playback system 16 may obtain loudspeaker information 13 indicative of a number of the speakers 3 and/or a spatial geometry of the speakers 3. In some instances, the audio playback system 16 may obtain the loudspeaker information 13 using a reference microphone and driving the speakers 3 in such a manner as to dynamically determine the speaker information 13. In other instances or in conjunction with the dynamic determination of the speaker information 13, the audio playback system 16 may prompt a user to interface with the audio playback system 16 and input the speaker information 13.

The audio playback system 16 may select one of the audio renderers 22 based on the speaker information 13. In some instances, the audio playback system 16 may, when none of the audio renderers 22 are within some threshold similarity measure (in terms of the loudspeaker geometry) to that specified in the speaker information 13, generate the one of audio renderers 22 based on the speaker information 13. The audio playback system 16 may, in some instances, generate the one of audio renderers 22 based on the speaker information 13 without first attempting to select an existing one of the audio renderers 22.

While described with respect to speaker feeds 25, the audio playback system 16 may render headphone feeds from either the speaker feeds 25 or directly from the HOA coefficients 11', outputting the headphone feeds to headphone speakers. The headphone feeds may represent binaural audio speaker feeds, which the audio playback system 16 renders using a binaural audio renderer.

The spatial audio encoding device 20 may encode (or, in other words, compress) the HOA audio data into a variable number of transport channels, each of which is allocated some amount of the bitrate using various bitrate allocation mechanisms. One example bitrate allocation mechanism allocates an equal number of bits to each transport channel. Another example bitrate allocation mechanism allocates bits to each of the transport channels based on an energy associated with each transport channel after each of the transport channels undergo gain control to normalize the gain of each of the transport channels.

The spatial audio encoding device 20 may provide transport channels 17 to the bitrate allocation unit 402 such that the bitrate allocation unit 402 may perform a number of different bitrate allocation mechanisms that may preserve the fidelity of the soundfield represented by each of transport channels. In this way, the spatial audio encoding device 20 may potentially avoid the introduction of audio artifacts while allowing for accurate perception of the soundfield from the various spatial directions.

The spatial audio encoding device 20 may output the transport channels 17 prior to performing gain control with respect to the transport channels 17. Alternatively, the spatial audio encoding device 20 may output the transport channels 17 after performing gain control, which the bitrate allocation unit 402 may undo through application of inverse gain control with respect to the transport channels 17 prior to performing one of the various bitrate allocation mechanisms.

In one example bitrate allocation mechanism, the bitrate allocation unit 402 may perform an energy analysis with respect to each of the transport channels 17 prior to application of gain control to normalize gain associated with each of the transport channels 17. Gain normalization may impact bitrate allocation as such normalization may result in each of the transport channels 17 being considered of equal importance (as energy is measured based, in large part, on gain). As such, performing energy-based bitrate allocation with respect to gain normalized transport channels 17 may result in nearly the same number of bits being allocated to each of the transport channels 17. Performing energy-based bitrate allocation with respect to the transport channels 17, prior to gain control (or after reversing gain control through application of inverse gain control to the transport channels 17), may thereby result in improved bitrate allocation that more accurately reflects the importance of each of the transport channels 17 in providing information relevant in describing the soundfield.

In another bitrate allocation mechanism, the bitrate allocation unit 402 may allocate bits to each of the transport channels 17 based on a spatial analysis of each of the transport channels 17. The bitrate allocation unit 402 may render each of the transport channels 17 to one or more spatial domain channels (which may be another way to refer to one or more loudspeaker feeds for a corresponding one or more loudspeakers at different spatial locations).

As an alternative to or in conjunction with the energy analysis, the bitrate allocation unit 402 may perform a perceptual entropy based analysis of the rendered spatial domain channels (for each of the transport channels 17) to identify to which of the transport channels 17 to allocate a respectively greater or lesser number of bits.

In some instances, the bitrate allocation unit 402 may supplement the perceptual entropy based analysis with a direction based weighting in which foregoing sounds are identified and allocated more bits relative to background sounds. The audio encoder may perform the direction based weighting and then perform the perceptual entropy based analysis to further refine the bit allocation to each of the transport channels 17.

In this respect, the bitrate allocation unit 402 may represent a unit configured to perform a bitrate allocation, based on an analysis (e.g., any combination of energy-based analysis, perceptual-based analysis, and/or directional-based weighting analysis) of transport channels 17 and prior to performing gain control with respect to the transport channels 17 or after performing inverse gain control with respect to the transport channels 17, to allocate bits to each of the transport channels 17. As a result of the bitrate allocation, the bitrate allocation unit 402 may determine a bitrate allocation schedule 19 indicative of a number of bits to be allocated to each of the transport channels 17. The bitrate allocation unit 402 may output the bitrate allocation schedule 19 to the psychoacoustic audio encoding device 406.

The psychoacoustic audio encoding device 406 may perform psychoacoustic audio encoding to compress each of the transport channels 17 until each of the transport channels 17 reaches the number of bits set forth in the bitrate allocation schedule 19. The psychoacoustic audio encoding device 406 may then specify the compressed version of each of the transport channels 19 in bitstream 21. As such, the psychoacoustic audio encoding device 406 may generate the bitstream 21 that specifies each of the transport channels 17 using the allocated number of bits.

The psychoacoustic audio encoding device 406 may specify, in the bitstream 21, the bitrate allocation per transport channel (which may also be referred to as the bitrate allocation schedule 19), which the audio decoding device 24 may parse from the bitstream 21. The audio decoding device 24 may then parse the transport channels 17 from the bitstream 21 based on the parsed bitrate allocation schedule 19, and thereby decode the HOA audio data set forth in each of the transport channels 17.

The audio decoding device 24 may, after parsing the compressed version of the transport channels 17, decode each of the compressed version of the transport channels 17 in two different ways. First, the audio decoding device 24 may perform psychoacoustic audio decoding with respect to each of the transport channels 17 to decompress the compressed version of the transport channels 17 and generate a spatially compressed version of the HOA audio data 15. Next, the audio decoding device 24 may perform spatial decompression with respect to the spatially compressed version of the HOA audio data 15 to generate (or, in other words, reconstruct) the HOA audio data 11'. The prime notation of the HOA audio data 11' denotes that the HOA audio data 11' may vary to some extent form the originally-captured HOA audio data 11 due to lossy compression, such as quantization, prediction, etc.

More information concerning decompression as performed by the audio decoding device 24 may be found in U.S. Pat. No. 9,489,955, entitled "Indicating Frame Parameter Reusability for Coding Vectors," issued Nov. 8, 2016, and having an effective filing date of Jan. 30, 2014. Additional information concerning decompression as performed by the audio decoding device 24 may also be found in U.S. Pat. No. 9,502,044, entitled "Compression of Decomposed Representations of a Sound Field," issued Nov. 22, 2016, and having an effective filing date of May 29, 2013. Furthermore, the audio decoding device 24 may be generally configured to operate as set forth in the above noted 3D Audio standard.

As noted above, the audio playback system 16 may select a single one of the audio renderers 22 that best matches the speaker information 13 or via some other procedure, and apply the single one of the audio renderers 22 to the HOA coefficients 11'. However, application of the single one of the audio renderers 22 may better render certain transport channels compared to other transport channels, and thereby increase an amount of error that occurs during playback, injecting audio artifacts that may decrease perceived quality.

In general, techniques are described for rendering different portions of HOA audio data 11' using different ones of the audio renderers 22. Rather than utilize a single renderer to render all of the various portions of the HOA audio data 11', the spatial audio encoding device 20 may associate different portions of the HOA audio data 11 with different audio renderers 22. In one example, the different portions may refer to different transport channels of a bitstream 21 representative of a compressed version of the HOA audio data 11.

Specifying different ones of the audio renderers 22 with respect to different transport channels may allow for less error compared to application of a single one of the audio renderers 22. As such, the techniques may reduce an amount of error that occurs during playback, and potentially prevent the injection of audio artifacts that may decrease perceived quality. In this respect, the techniques may improve perceived audio quality, resulting in more accurate audio reproduction, improving the operation of the spatial audio encoding device 20 and the audio playback system 16 themselves.

In operation, the spatial audio encoding device 20 may specify, in the bitstream 15, a first indication identifying a first audio renderer of a plurality of the audio renderers 22 to be applied to a first portion of the audio data 11. In some examples, the spatial audio encoding device 20 may specify a renderer identifier and a corresponding first audio renderer (which may be in the form of renderer matrix coefficients).

Although described as fully specifying each renderer matrix coefficient for every row and column of the renderer matrix, the spatial audio encoding device 20 may attempt to reduce the number of matrix coefficients explicitly specified in the bitstream 15 through application of compression that leverages sparseness and/or symmetry properties that may occur in the renderer matrix. That is, the first audio renderer may be represented in the bitstream 15 by sparseness information indicative of a sparseness of the renderer matrix, which the spatial audio encoding device 20 may specify in order to signal that various matrix coefficients are not specified in the bitstream 15. More information regarding how the spatial audio encoding device 20 may obtain the sparseness information, specify the renderer identifier, and associated renderer matrix coefficients and thereby reduce the number of matrix coefficients specified in the bitstream 15 can be found in U.S. Pat. No. 9,609,452, entitled "OBTAINING SPARSENESS INFORMATION FOR HIGHER ORDER AMBISONIC AUDIO RENDERERS," which issued on Mar. 28, 2017, and U.S. Pat. No. 9,870,778, entitled "OBTAINING SPARSENESS INFORMATION FOR HIGHER ORDER AMBISONIC AUDIO RENDERERS," which issued on Jan. 16, 2018.

The first audio renderer may also, in some examples and either in conjunction with or as an alternative to the sparseness information, be represented using symmetry information that indicates a symmetry of the renderer matrix, which the spatial audio encoding device 20 may specify in order to signal that various matrix coefficients are not specified in the bitstream 15. The symmetry information may include value symmetry information that indicates value symmetry of the renderer matrix and/or sign symmetry information that indicates sign symmetry of the renderer matrix. More information regarding how the spatial audio encoding device 20 may obtain the sparseness information, the renderer identifier, and the associated render matrix coefficients, and thereby reduce the number of matrix coefficients specified in the bitstream 15 can be found in U.S. Pat. No. 9,883,310, entitled "OBTAINING SYMMETRY INFORMATION FOR HIGHER ORDER AMBISONIC AUDIO RENDERERS," which issued on Jan. 30, 2018.

The spatial audio encoding device 20 may also specify, in the bitstream 15, the first portion of the audio data. Although described with respect to the HOA audio data 11 (which is another way to refer to the HOA coefficients 11) in the example of FIG. 2, the techniques may be performed with respect to any type of audio data, including channel-based audio data, object-based audio data, or any other type of audio data.

In the example of FIG. 2, the first portion of the HOA audio data 11 may refer to a first transport channel of the bitstream 15 that specifies for a period of time a compressed version of an ambient HOA coefficient or a compressed version of a predominant audio signal decomposed from the HOA audio data 11 in the manner described above. The ambient HOA coefficient may include one of the HOA coefficients 11 associated with a zero-order spherical basis function or a first-order spherical basis functions—and commonly denoted by one of the variables X, Y, Z, or W. The ambient HOA coefficient may also include one of the HOA coefficients 11 associated with a second-order or higher spherical basis function that is determined to be relevant in describing the ambient component of the soundfield.

The spatial audio encoding device 20 may also specify, in the bitstream 15, a second indication identifying a second one of the audio renderers 22 of the plurality of audio renderers 22 to be applied to a second portion of the HOA audio data 11. In some examples, the spatial audio encoding device 20 may specify a renderer identifier and a corresponding second audio renderer (which may be in the form of renderer matrix coefficients).

Although described as fully specifying each renderer matrix coefficient for every row and column of the renderer matrix, the spatial audio encoding device 20 may attempt to reduce the number of matrix coefficients explicitly specified in the bitstream 15 through application of compression that leverages sparseness and/or symmetry properties that may occur in the renderer matrix as described above with respect to the first audio render. That is, the second audio renderer may be represented in the bitstream 15 by sparseness information indicative of a sparseness of the second renderer matrix, which the spatial audio encoding device 20 may specify in order to signal that various matrix coefficients are not specified in the bitstream 15.

The second audio renderer may also, in some examples and either in conjunction with or as an alternative to the sparseness information, be represented using symmetry information that indicates a symmetry of the second renderer matrix, which the spatial audio encoding device 20 may specify in order to signal that various matrix coefficients are not specified in the bitstream 15. Again, the symmetry information may include value symmetry information that indicates value symmetry of the renderer matrix and/or sign symmetry information that indicates sign symmetry of the renderer matrix.

The spatial audio encoding device 20 may also specify, in the bitstream 15, the second portion of the HOA audio data 11. Although described with respect to the HOA audio data 11 (which is another way to refer to the HOA coefficients 11) in the example of FIG. 2, the techniques may again be performed with respect to any type of audio data, including channel-based audio data, object-based audio data, or any other type of audio data.

In the example of FIG. 2, the second portion of the HOA audio data 11 may refer to a second transport channel of the bitstream 15 that specifies, for a period of time, a compressed version of an ambient HOA coefficient or a compressed version of a predominant audio signal decomposed from the HOA audio data 11 in the manner described above. In some examples, the second portion of the HOA audio data 11 may represent the soundfield for a concurrent period of time or the same period of time as that for which the first transport channel specifies the first portion of the HOA audio data 11.

In other words, the first transport channel may include one or more first frames representative of the first portion of the HOA audio data 11, and the second transport channels may include one or more second frames representative of the second portion of the HOA audio data 11. Each of the first frames may be synchronized approximately in time to a corresponding one of the second frames. The indications for which of the first audio renderer and the second audio renderer may specify to which of the first frames and the second frames the first renderer and the second render are to be applied respectively, resulting in concurrent or potentially synchronized application of the first and the second audio renderers.

In any event, the spatial audio encoding device 20 may output the bitstream 15, which undergoes psychoacoustic audio encoding as described above to transform into the bitstream 21. The content creator system 12 may output the bitstream 21 to the audio decoding device 24.

The audio decoding device 24 may operate reciprocally to the spatial audio encoding device 20. That is, the audio decoding device 24 may obtain the first audio renderer of the plurality of audio renderers 22. In some examples, the audio decoding device 24 may obtain the first audio renderer from the bitstream 21 (and store the first audio renderer as one of the audio renderers 22). The audio decoding device 24 may associate the first audio renderer with the renderer identifier specified in the bitstream 21 relative to the first audio renderer. Furthermore, the audio decoding device 24 may reconstruct, based on the symmetry and/or sparseness information, a first renderer matrix from first renderer matrix coefficients set forth in the bitstream 21 as described in the above referenced U.S. patents. In this respect, the audio decoding device 24 may obtain, from the bitstream 21, a first indication (e.g., the renderer identifier, the renderer matrix coefficients, the sparseness information, and/or the symmetry information) identifying the first audio renderer.

The audio decoding device 24 may obtain a second audio renderer of the plurality of audio renderers 22. In some examples, the audio decoding device 24 may obtain the second audio renderer from the bitstream 21 (and store the first audio renderer as one of the audio renderers 22). The audio decoding device 24 may associate the second audio renderer with the renderer identifier specified in the bitstream 21 relative to the second audio renderer. Furthermore, the audio decoding device 24 may reconstruct, based on the symmetry and/or sparseness information, a second renderer matrix from second renderer matrix coefficients set forth in the bitstream 21 as described in the above referenced U.S. patents. In this respect, the audio decoding device 24 may obtain, from the bitstream 21, a first indication (e.g., the renderer identifier, the renderer matrix coefficients, the sparseness information, and/or the symmetry information) identifying the second audio renderer.

The audio decoding device 24 may also apply the first audio renderer with respect to the first portion of the audio data (e.g., extracted and decoded/decompressed from the bitstream 21) to obtain one or more first speaker feeds of the speaker feeds 25. The audio decoding device 24 may further apply the second audio renderer with respect to the second portion of the audio data (e.g., extracted and decoded/decompressed from the bitstream 21) to obtain one or more second speaker feeds of the speaker feeds 25. The audio playback system 16 may output, to the speakers 3, the one or more first speaker feeds and the one or more second speaker feeds. More information regarding the association of the audio renderers to the portions of the HOA audio data 11 is described with respect to the examples of FIGS. 5A-5D.

Figure 5A:
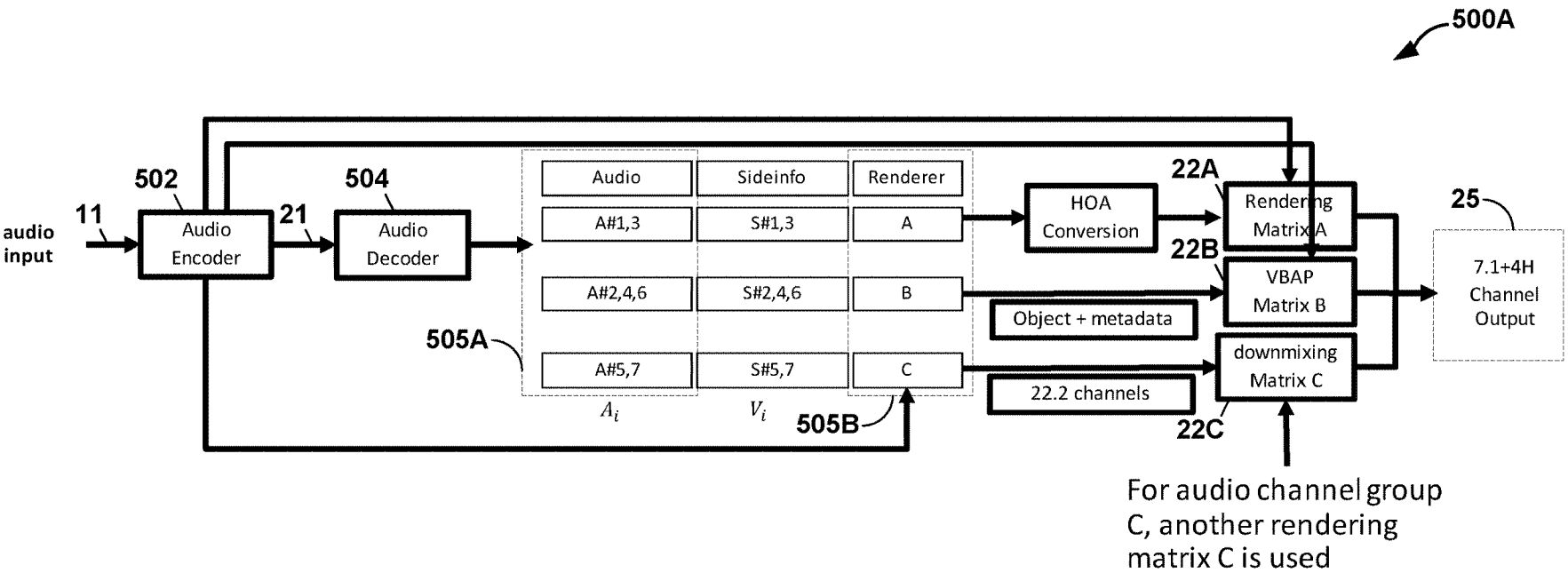
FIGS. 5A-5D are block diagrams illustrating examples of the system shown in FIGS. 2-4 in more detail.

FIGS. 5A-5D are block diagrams illustrating different configurations of the system shown in the example of FIG. 2. In the example of FIG. 5A, a system 500A represents a first configuration of the system 10 shown in the example of FIG. 2. The system 500A may include an audio encoder 502, an audio decoder 24, and different audio renderers 22A-22C.

The audio encoder 502 may represent one or more of the spatial audio encoding device 20, the bitrate allocation unit 402, and the psychoacoustic audio encoding device 406. The audio decoder 24 may be another way by which to refer to the audio decoding device 24. The audio renderers 22A-22C may represent different ones of the audio renderers 22. The audio renderer 22A may represent an HOA-to-channel rendering matrix. The audio renderer 22B may represent an object-to-channel rendering matrix (that utilizes VBAP). The audio renderer 22C may represent a downmixing matrix to downmix channel-based audio data into a lower number of channels.

The audio decoder 504 may obtain, from the bitstream 21, indications 505A and 505B that associate one or more of the transport channels specified by indications 505A to one of the audio renderers 22A-22C identified by indication 505B. In the example of FIG. 5A, the indications 505A and 505B associate transport channels (under the heading "Audio" in the first entry stating "A" followed by a number in indications 505A) 1 and 3 to the audio renderer 22A (identified by "Renderer" followed by the letter "A" in the first entry of the indications 505B), the transport channels (under the heading "Audio" in the second entry stating "A" followed by a number in indications 505A) 2, 4, and 6 to the audio renderer 22B (identified by "Renderer" followed by the letter "B" in the second entry of the indications 505B), and the transport channels (under the heading "Audio" in the third entry stating "A" followed by a number in indications 505A) 5 and 7 to the audio renderer 22C (identified by "Renderer" followed by the letter "C" in the third entry of the indications 505B).

The audio decoder 504 may obtain, from the bitstream 21, the audio renderers 22A and 22B (shown as the audio encoder 502 providing the audio renderers 22A and 22B). The audio decoder 504 may also obtain an indication identifying the audio renderer 22C, which the audio decoder 504 may obtain from the pre-existing or previously configured audio renderers 22. The indication for the audio renderer 22C may include a renderer identifier.

The playback audio system 16 may apply the audio renderers 22A-22C to the transport channels of the audio data 11 identified by indications 505A. As shown in the example of FIG. 5A, the audio playback system 16 may perform HOA conversion to convert the transport channels 1 and 3 to HOA coefficients prior to applying the audio renderer 22A. In any event, the result of applying the audio renderers 22A-22C in this example is speaker feeds 25 conforming to a 7.1 surround sound format plus four channels that provide added height (4H).

Figure 5B:
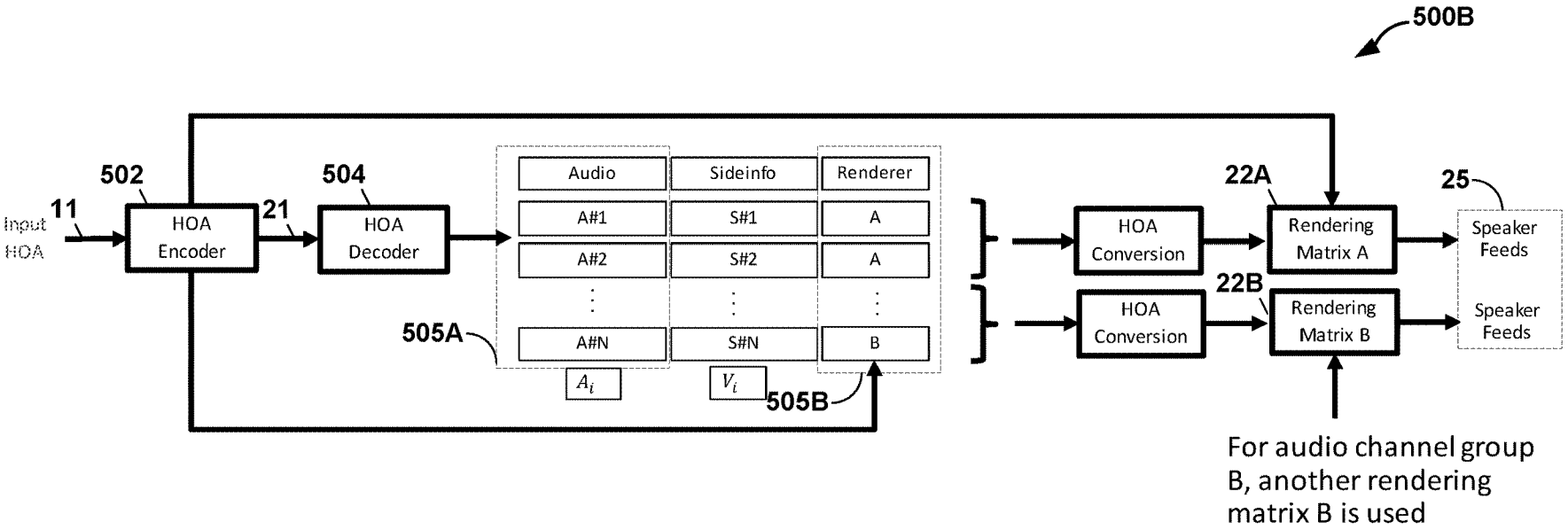

In the example of FIG. 5B, a system 500B represents a second configuration of the system 10 shown in FIG. 2. The system 500B is similar to the system 500A except for the difference in rendering described below.

The audio decoder 504 shown in FIG. 5B may obtain, from the bitstream 21, indications 505A and 505B that associate one or more of the transport channels specified by indications 505A to one of the audio renderers 22A and 22B identified by indication 505B. In the example of FIG. 5B, the indications 505A and 505B associate the transport channel (under the heading "Audio" in the first entry stating "A" followed by a number in indications 505A) 1 to the audio renderer 22A (identified by "Renderer" followed by the letter "A" in the first entry of the indications 505B), the transport channels (under the heading "Audio" in the second entry stating "A" followed by a number in indications 505A) 2 to the audio renderer 22A (identified by "Renderer" followed by the letter "A" in the second entry of the indications 505B), and the transport channels (under the heading "Audio" in the third entry stating "A" followed by a number in indications 505A) N to the audio renderer 22B (identified by "Renderer" followed by the letter "B" in the third entry of the indications 505B).

The audio decoder 504 may obtain, form the bitstream 21, the audio renderer 22A (shown as the audio encoder 502 providing the audio renderer 22A). The audio decoder 504 may also obtain an indication identifying the audio renderer 22B, which the audio decoder 504 may obtain from the pre-existing or previously configured audio renderers 22. The indication for the audio renderer 22B may include a renderer identifier.

The playback audio system 16 may apply the audio renderers 22A and 22B to the transport channels of the audio data 11 identified by indications 505A. As shown in the example of FIG. 5B, the audio playback system 16 may perform HOA conversion to convert the transport channels 1-N to HOA coefficients prior to applying the audio renderers 22A and 22B. In any event, the result of applying the audio renderers 22A and 22B in this example is speaker feeds 25.

Figure 5C:
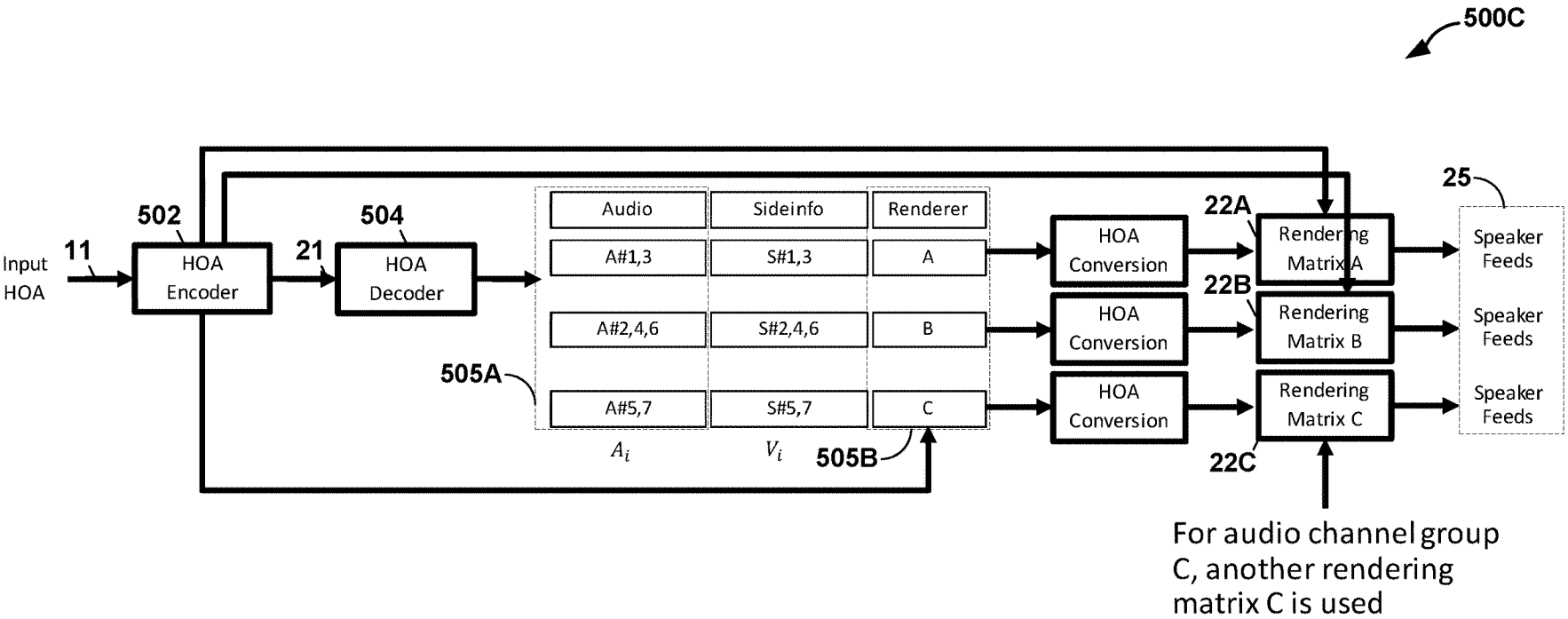

In the example of FIG. 5C, a system 500C represents a third configuration of the system 10 shown in FIG. 2. The system 500C is similar to the system 500A except for the difference in rendering described below.

The audio decoder 504 may obtain, from the bitstream 21, indications 505A and 505B that associate one or more of the transport channels specified by indications 505A to one of the audio renderers 22A-22C identified by indication 505B. In the example of FIG. 5C, the indications 505A and 505B associate transport channels (under the heading "Audio" in the first entry stating "A" followed by a number in indications 505A) 1 and 3 to the audio renderer 22A (identified by "Renderer" followed by the letter "A" in the first entry of the indications 505B), the transport channels (under the heading "Audio" in the second entry stating "A" followed by a number in indications 505A) 2, 4, and 6 to the audio renderer 22B (identified by "Renderer" followed by the letter "B" in the second entry of the indications 505B), and the transport channels (under the heading "Audio" in the third entry stating "A" followed by a number in indications 505A) 5 and 7 to the audio renderer 22C (identified by "Renderer" followed by the letter "C" in the third entry of the indications 505B).

The audio decoder 504 may obtain, from the bitstream 21, the audio renderers 22A and 22B (shown as the audio encoder 502 providing the audio renderers 22A and 22B). The audio decoder 504 may also obtain an indication identifying the audio renderer 22C, which the audio decoder 504 may obtain from the pre-existing or previously configured audio renderers 22. The indication for the audio renderer 22C may include a renderer identifier.

The playback audio system 16 may apply the audio renderers 22A-22C to the transport channels of the audio data 11 identified by indications 505A. As shown in the example of FIG. 5A, the audio playback system 16 may perform HOA conversion to convert the transport channels 1-7 to HOA coefficients prior to applying the audio renderers 22A-22C. In any event, the result of applying the audio renderers 22A-22C in this example is speaker feeds 25.

Figure 5D:
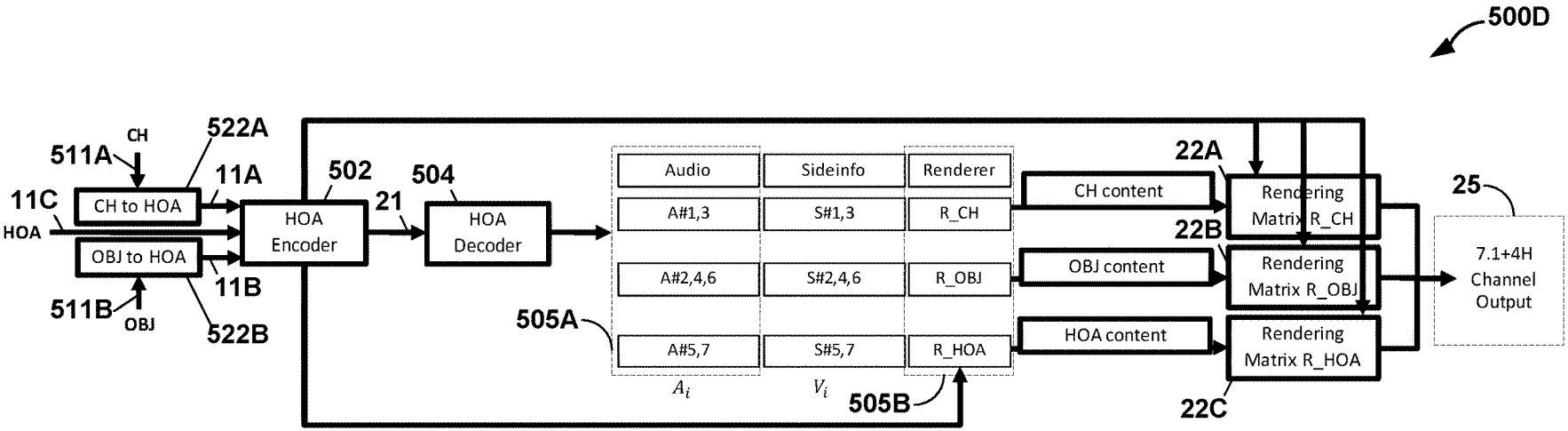

In the example of FIG. 5D, a system 500D represents a second configuration of the system 10 shown in FIG. 2. The system 500B is similar to the system 500A except for the difference in rendering described below.

Rather than simply obtain audio data 11 as described above with respect to the system 500A, the spatial audio encoding device 20 or some other unit (such as the HOA transcoder 400) may apply a channel-to-ambisonic renderer 522A with respect to channel-based audio data 511A to obtain HOA audio data 11A. The spatial audio encoding device 20 or some other unit (such as the HOA transcoder 400) may apply an object-to-ambisonic renderer 522B with respect to object-based audio data 511B to obtain HOA audio data 11B. As such, in addition to the HOA audio data 11C, the audio encoder 502 may receive the HOA audio data 11A and the HOA audio data 11B.

More information concerning how the spatial audio encoding device 20 may convert the channel-based audio data 511A and the object-based audio data 511B to the HOA audio data 11A and 11B can be found in U.S. Pat. No. 9,961,467, entitled "CONVERSION FROM CHANNEL-BASED AUDIO TO HOA," which issued May 1, 2018, U.S. Pat. No. 9,961,475, entitled "CONVERSION FROM OBJECT-BASED AUDIO TO HOA," which issued May 1, 2018, and U.S. Publication No. 2017/0103766 A1, entitled "QUANTIZATION OF SPATIAL VECTORS," which published on Apr. 13, 2017.

The audio encoder 502 may encode/compress the HOA audio data 11A-11C and also separately specify an ambisonic-to-channel audio renderer 22A and an ambisonic-to-object audio renderer 22B in the bitstream 21 in any of the ways described above. The ambisonic-to-channel audio renderer 22A may represent an inverse (where it should be understood that the inverse may refer to a pseudo-inverse in the context of matrix math as well as other approximations) of the channel-to-ambisonic audio renderer 522A. The ambisonic-to-channel audio renderer 22A may, in other words, operate reciprocally to the channel-to-ambisonic audio renderer 522A. The ambisonic-to-object audio renderer 22B may represent an inverse (where it should be understood that the inverse may refer to a pseudo-inverse in the context of matrix math as well as other approximations) of the object-to-ambisonic audio renderer 522B. The ambisonic-to-object audio renderer 22B may, in other words, operate reciprocally to the object-to-ambisonic audio renderer 522B.

The audio decoder 504 may obtain, from the bitstream 21, indications 505A and 505B that associate one or more of the transport channels specified by indications 505A to one of the audio renderers 22A-22C identified by indication 505B. In the example of FIG. 5D, the indications 505A and 505B associate transport channels (under the heading "Audio" in the first entry stating "A" followed by a number in indications 505A) 1 and 3 to the audio renderer 22A (identified by "Renderer" followed by the letter "R_CH"—renderer_channel—in the first entry of the indications 505B), the transport channels (under the heading "Audio" in the second entry stating "A" followed by a number in indications 505A) 2, 4, and 6 to the audio renderer 22B (identified by "Renderer" followed by the letter "R_OBJ"—renderer_object—in the second entry of the indications 505B), and the transport channels (under the heading "Audio" in the third entry stating "A" followed by a number in indications 505A) 5 and 7 to the audio renderer 22C (identified by "Renderer" followed by the letter "R_HOA"—renderer_ambisonic—in the third entry of the indications 505B).

The audio decoder 504 may obtain, from the bitstream 21, the audio renderers 22A-22C (shown as the audio encoder 502 providing the audio renderers 22A-22C). The playback audio system 16 may apply the audio renderers 22A-22C to the transport channels of the HOA audio data 11' identified by indications 505A. As shown in the example of FIG. 5D, the audio playback system 16 may not perform any HOA conversion to convert the transport channels 1-7 to HOA coefficients prior to applying the audio renderers 22A-22C. In any event, the result of applying the audio renderers 22A-22C in this example is speaker feeds 25 conforming in this example to a 7.1 surround sound format plus four channels that provide added height (4H).

Figure 3A:
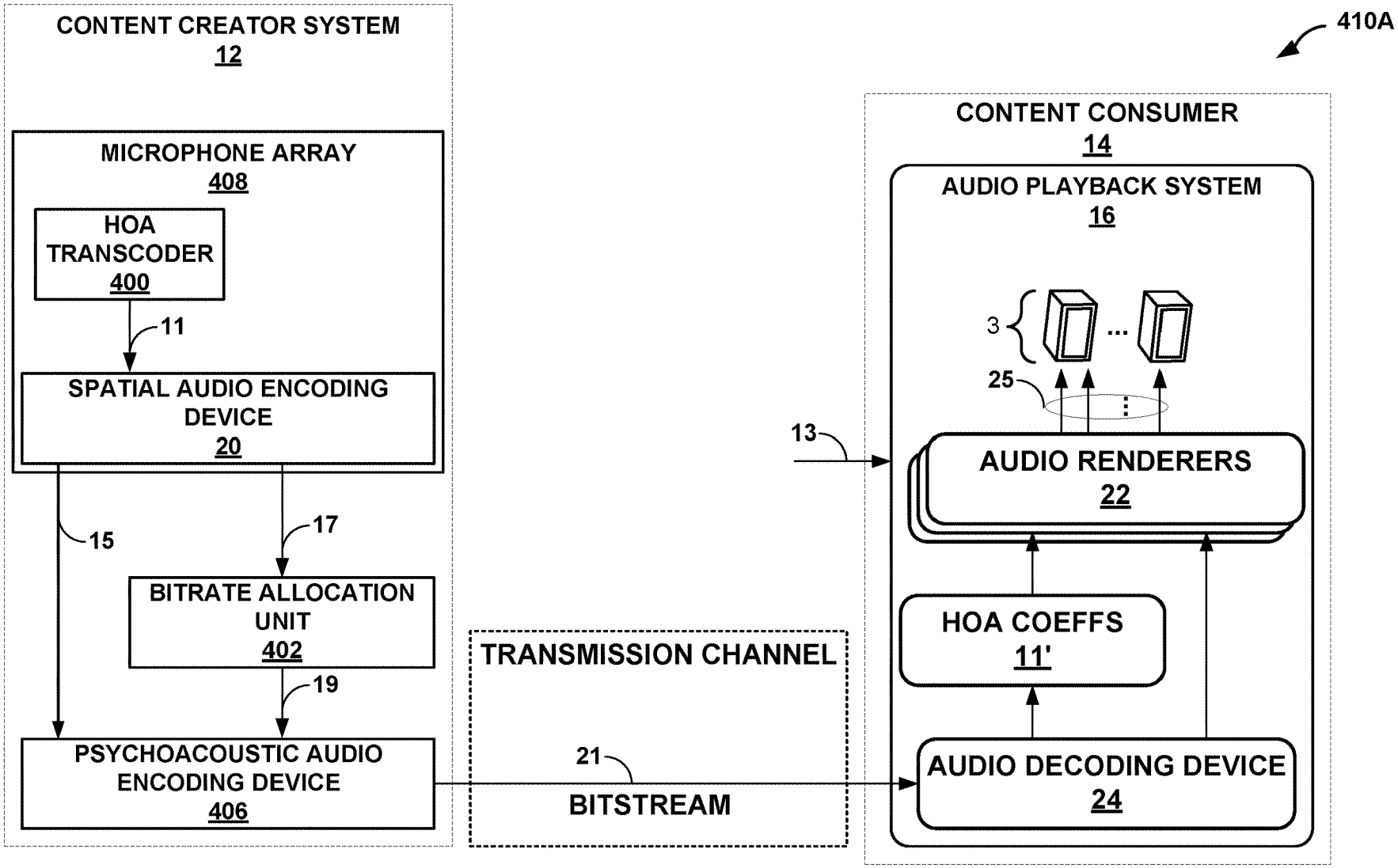
FIGS. 3A-3D are diagrams illustrating different examples of the system shown in the example of FIG. 2.

FIGS. 3A-3D are block diagrams illustrating different examples of a system that may be configured to perform various aspects of the techniques described in this disclosure. The system 410A shown in FIG. 3A is similar to the system 10 of FIG. 2, except that the microphone array 5 of the system 10 is replaced with a microphone array 408. The microphone array 408 shown in the example of FIG. 3A includes the HOA transcoder 400 and the spatial audio encoding device 20. As such, the microphone array 408 generates the spatially compressed HOA audio data 15, which is then compressed using the bitrate allocation in accordance with various aspects of the techniques set forth in this disclosure.

Figure 3B:
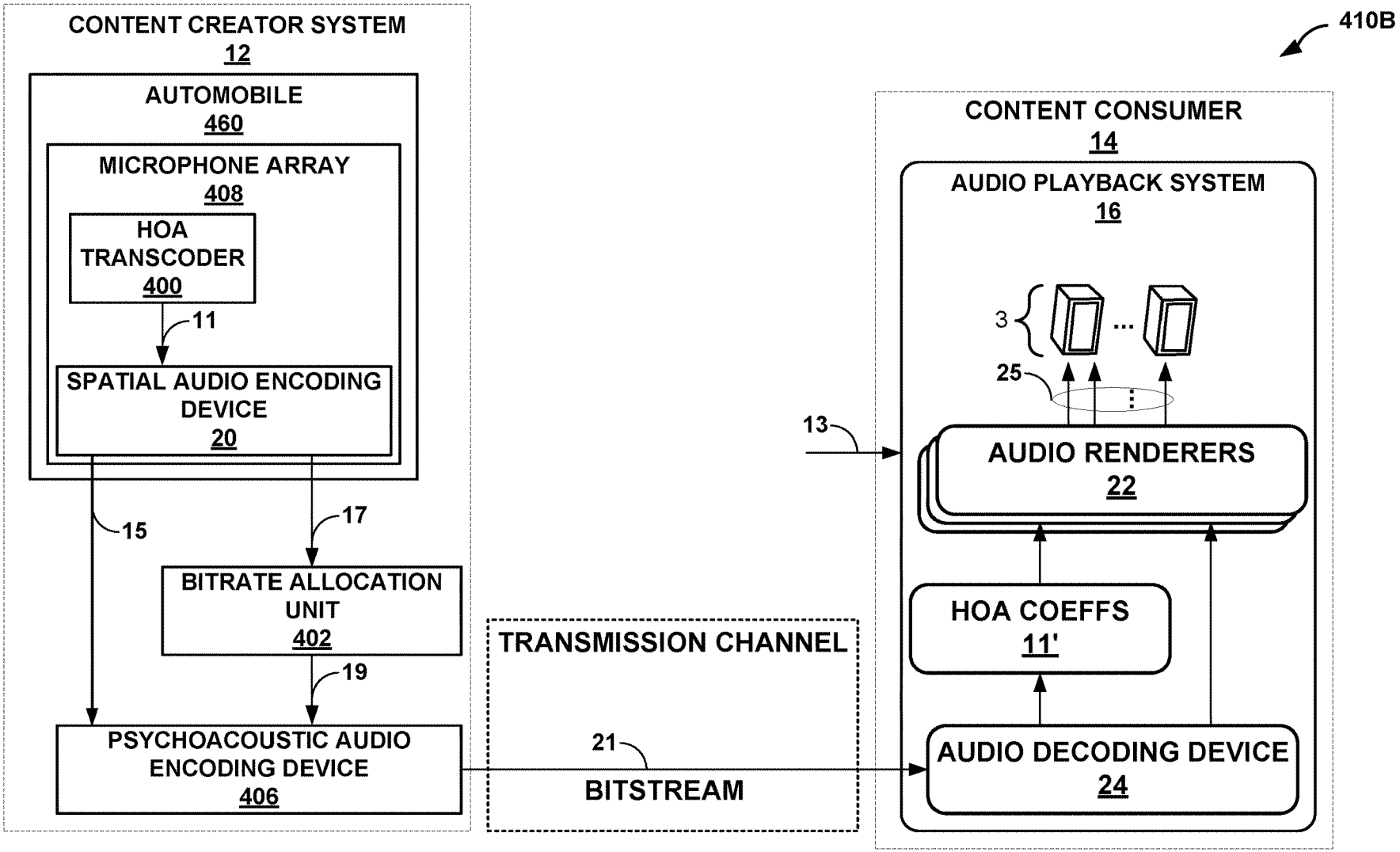

The system 410B shown in FIG. 3B is similar to the system 410A shown in FIG. 3A except that an automobile 460 includes the microphone array 408. As such, the techniques set forth in this disclosure may be performed in the context of automobiles.

Figure 3C:
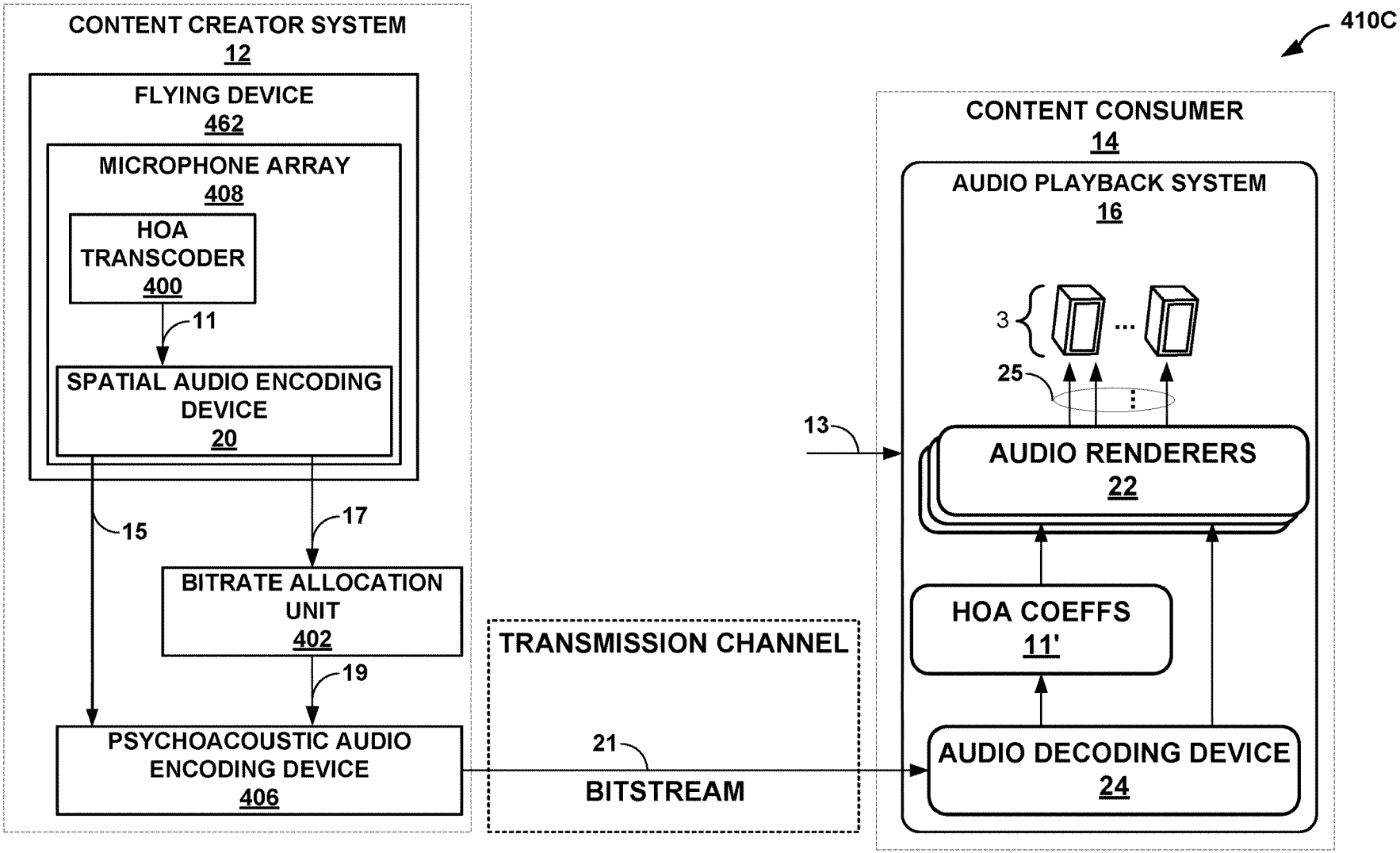

The system 410C shown in FIG. 3C is similar to the system 410A shown in FIG. 3A except that a remotely-piloted and/or autonomous controlled flying device 462 includes the microphone array 408. The flying device 462 may for example represent a quadcopter, a helicopter, or any other type of drone. As such, the techniques set forth in this disclosure may be performed in the context of drones.

Figure 3D:
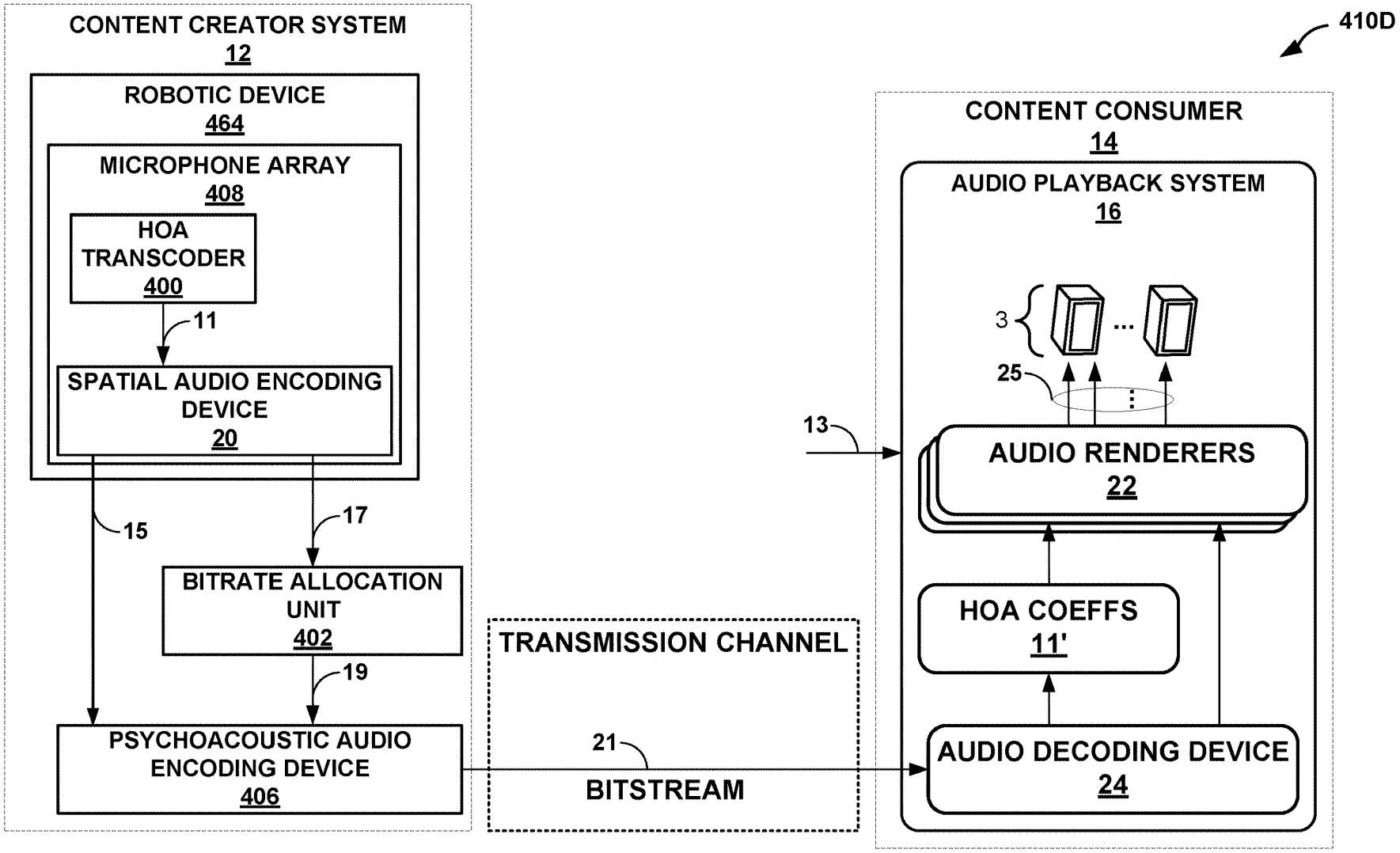

The system 410D shown in FIG. 3D is similar to the system 410A shown in FIG. 3A except that a robotic device 464 includes the microphone array 408. The robotic device 464 may for example represent a device that operates using artificial intelligence, or other types of robots. In some examples, the robotic device 464 may represent a flying device, such as a drone. In other examples, the robotic device 464 may represent other types of devices, including those that do not necessarily fly. As such, the techniques set forth in this disclosure may be performed in the context of robots.

Figure 4:
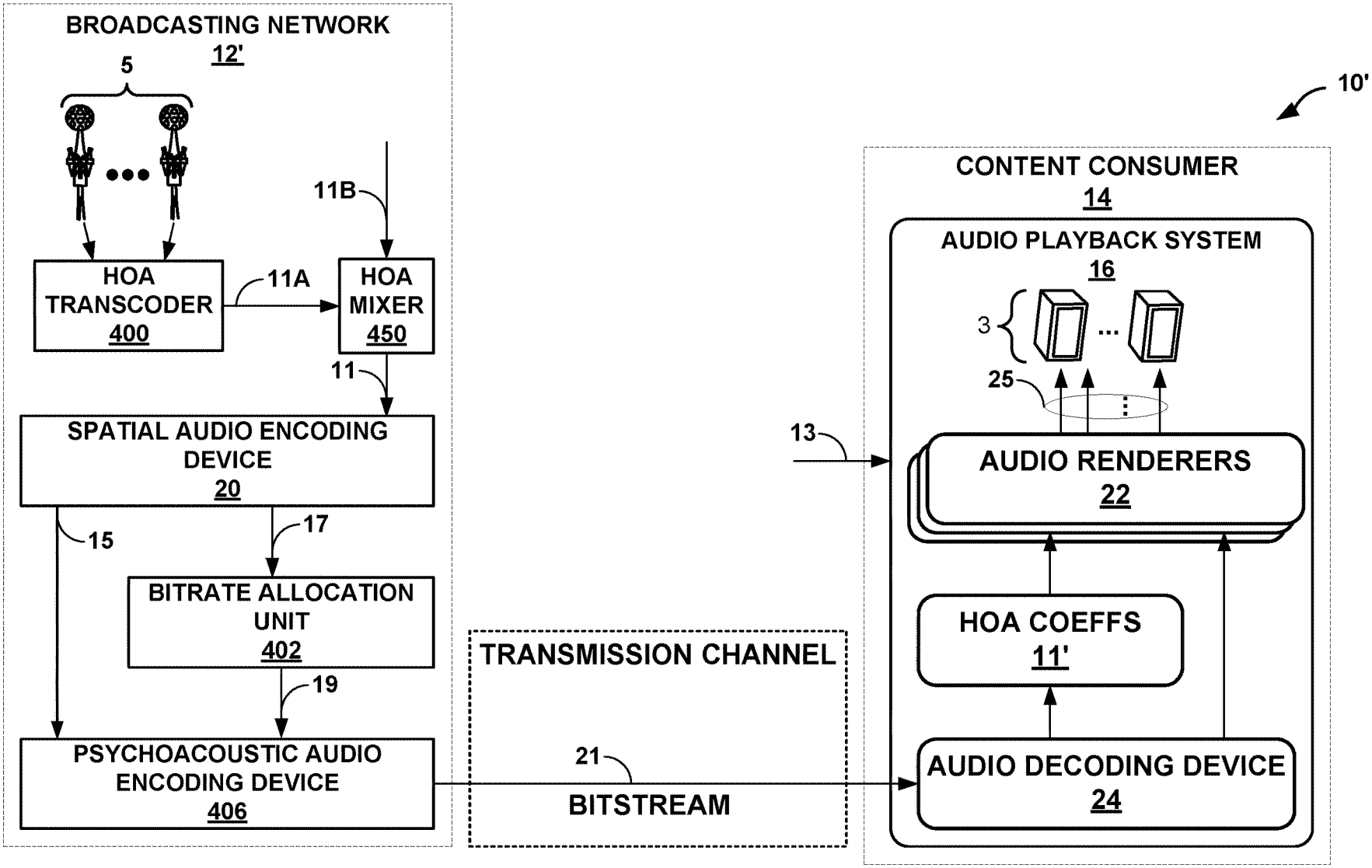
FIG. 4 is a block diagram illustrating another example of the system shown in the example of FIG. 2.

FIG. 4 is a block diagram illustrating another example of a system that may be configured to perform various aspects of the techniques described in this disclosure. The system shown in FIG. 4 is similar to the system 10 of FIG. 2 except that the content creation network 12 is a broadcasting network 12', which also includes an additional HOA mixer 450. As such, the system shown in FIG. 4 is denoted as system 10' and the broadcast network of FIG. 4 is denoted as broadcast network 12'. The HOA transcoder 400 may output the live feed HOA coefficients as HOA coefficients 11A to the HOA mixer 450. The HOA mixer represents a device or unit configured to mix HOA audio data. HOA mixer 450 may receive other HOA audio data 11B (which may be representative of any other type of audio data, including audio data captured with spot microphones or non-3D microphones and converted to the spherical harmonic domain, special effects specified in the HOA domain, etc.) and mix this HOA audio data 11B with HOA audio data 11A to obtain HOA coefficients 11.

Figure 6:
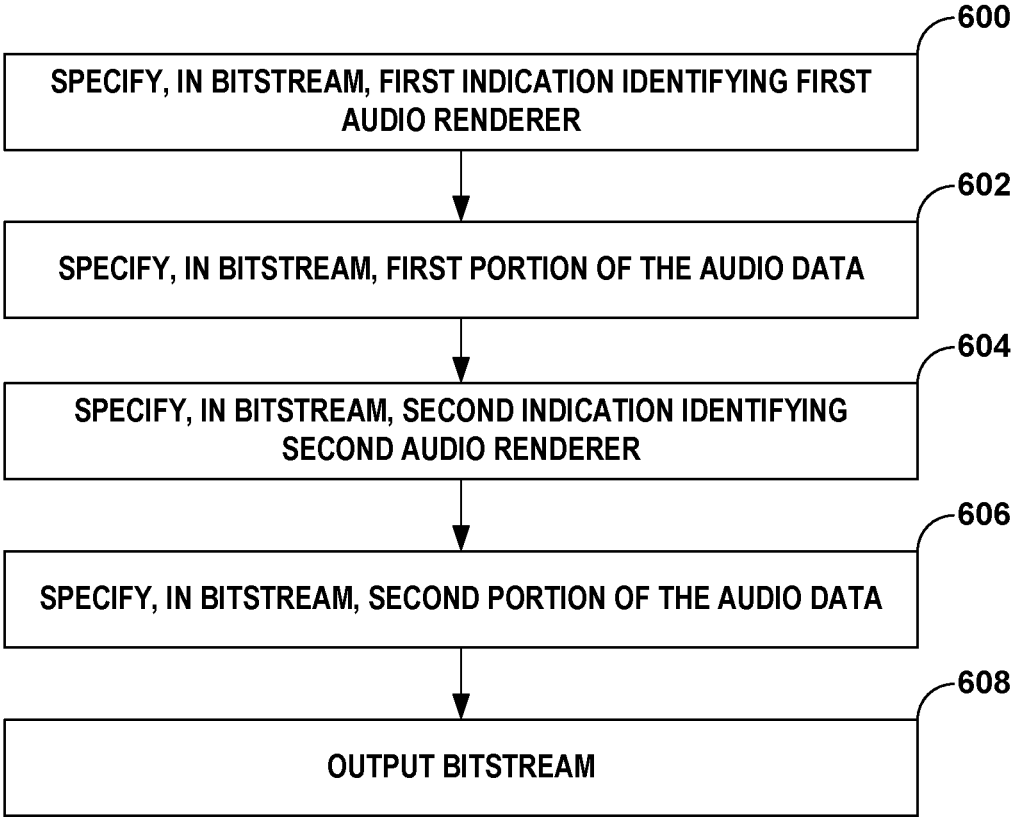
FIG. 6 is a flowchart illustrating example operation of the audio encoding device of FIG. 2 in accordance with various aspects of the techniques described in this disclosure.

FIG. 6 is a flowchart illustrating example operation of the audio encoding device of FIG. 2 in accordance with various aspects of the techniques described in this disclosure. The spatial audio encoding device 20 may specify, in the bitstream 15, a first indication identifying a first audio renderer of a plurality of the audio renderers 22 to be applied to a first portion of the audio data 11 (600). In some examples, the spatial audio encoding device 20 may specify a renderer identifier and a corresponding first audio renderer (which may be in the form of renderer matrix coefficients).

The spatial audio encoding device 20 may also specify, in the bitstream 15, the first portion of the audio data (602). Although described with respect to the HOA audio data 11 (which is another way to refer to the HOA coefficients 11) in the example of FIG. 2, the techniques may be performed with respect to any type of audio data, including channel-based audio data, object-based audio data, or any other type of audio data.

The spatial audio encoding device 20 may also specify, in the bitstream 15, a second indication identifying a second one of the audio renderers 22 of the plurality of audio renderers 22 to be applied to a second portion of the HOA audio data 11 (604). In some examples, the spatial audio encoding device 20 may specify a renderer identifier and a corresponding second audio renderer (which may be in the form of renderer matrix coefficients).

The spatial audio encoding device 20 may also specify, in the bitstream 15, the second portion of the HOA audio data 11 (606). Although described with respect to the HOA audio data 11 (which is another way to refer to the HOA coefficients 11) in the example of FIG. 2, the techniques may again be performed with respect to any type of audio data, including channel-based audio data, object-based audio data, or any other type of audio data.

The spatial audio encoding device 20 may output the bitstream 15 (608), which undergoes psychoacoustic audio encoding as described above to transform into the bitstream 21. The content creator system 12 may output the bitstream 21 to the audio decoding device 24.

Figure 7:
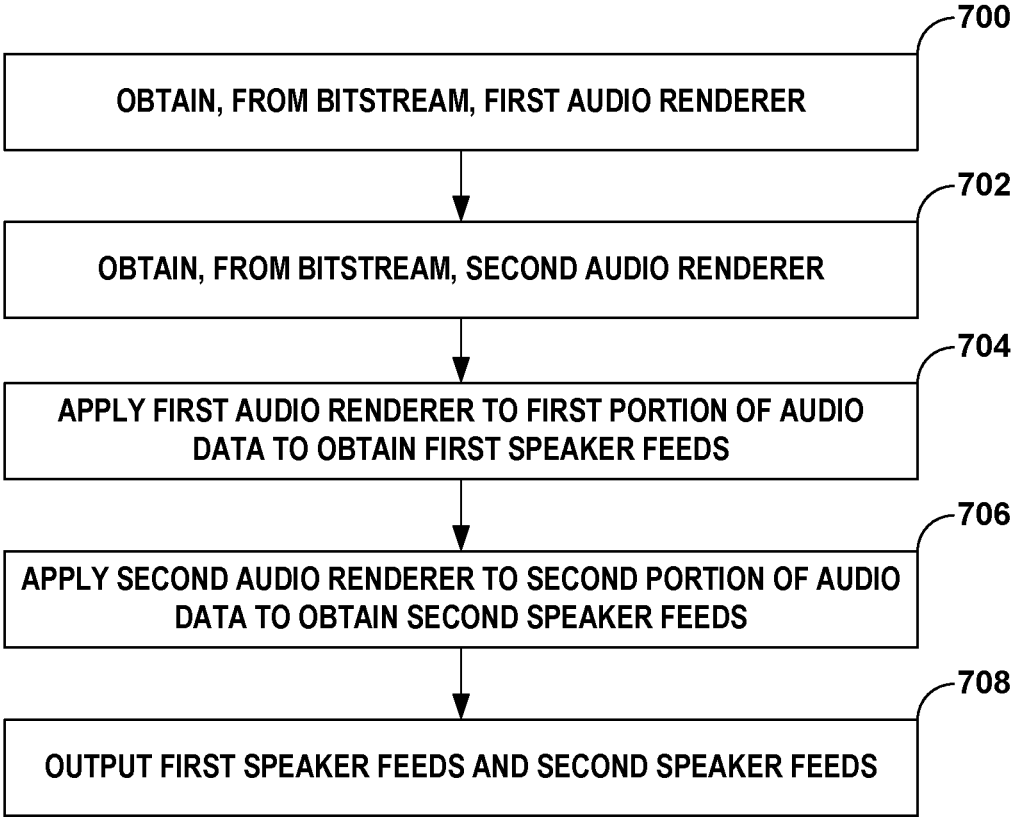
FIG. 7 is a flowchart illustrating example operation of the audio decoding device of FIG. 2 in performing various aspects of the techniques described in this disclosure.

FIG. 7 is a flowchart illustrating example operation of the audio decoding device of FIG. 2 in performing various aspects of the techniques described in this disclosure. As described above, the audio decoding device 24 may operate reciprocally to the spatial audio encoding device 20. That is, the audio decoding device 24 may obtain the first audio renderer of the plurality of audio renderers 22 (700). In some examples, the audio decoding device 24 may obtain the first audio renderer from the bitstream 21 (and store the first audio renderer as one of the audio renderers 22). The audio decoding device 24 may associate the first audio renderer with the renderer identifier specified in the bitstream 21 relative to the first audio renderer.

The audio decoding device 24 may obtain, from the bitstream 21, a second audio renderer of the plurality of audio renderers 22 (702). In some examples, the audio decoding device 24 may obtain the second audio renderer from the bitstream 21 (and store the first audio renderer as one of the audio renderers 22). The audio decoding device 24 may associate the second audio renderer with the renderer identifier specified in the bitstream 21 relative to the second audio renderer. In this respect, the audio decoding device 24 may obtain, from the bitstream 21, a first indication (e.g., the renderer identifier, the renderer matrix coefficients, the sparseness information, and/or the symmetry information) identifying the second audio renderer.

The audio decoding device 24 may also apply the first audio renderer with respect to the first portion of the audio data (e.g., extracted and decoded/decompressed from the bitstream 21) to obtain one or more first speaker feeds of the speaker feeds 25 (704). The audio decoding device 24 may further apply the second audio renderer with respect to the second portion of the audio data (e.g., extracted and decoded/decompressed from the bitstream 21) to obtain one or more second speaker feeds of the speaker feeds 25 (706). The audio playback system 16 may output, to the speakers 3, the one or more first speaker feeds and the one or more second speaker feeds (708).

In some contexts, such as broadcasting contexts, the audio encoding device may be split into a spatial audio encoder, which performs a form of intermediate compression with respect to the HOA representation that includes gain control, and a psychoacoustic audio encoder 406 (which may also be referred to as a "perceptual audio encoder 406") that performs perceptual audio compression to reduce redundancies in data between the gain normalized transport channels. In these instances, the bitrate allocation unit 402 may perform inverse gain control to recover the original transport channel 17, where the psychoacoustic audio encoding device 406 may perform the energy-based bitrate allocation, directional bitrate allocation, perceptual based bitrate allocation, or some combination thereof based on bitrate schedule 19 in accordance with various aspects of the techniques described in this disclosure.

Although described in this disclosure with respect to the broadcasting context, the techniques may be performed in other contexts, including the above noted automobiles, drones, and robots, as well as, in the context of a mobile communication handset or other types of mobile phones, including smart phones (which may also be used as part of the broadcasting context).

In addition, the foregoing techniques may be performed with respect to any number of different contexts and audio ecosystems and should not be limited to any of the contexts or audio ecosystems described above. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIG. 5.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIG. 5.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front speakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors (which may be denoted as "processor(s)") may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

As such, various aspects of the techniques may enable one or more devices to operate in accordance with the following clauses.

Clause 45A. A device configured to render audio data representative of a soundfield, the device comprising: means for obtaining a first audio renderer of a plurality of audio renderers; means for applying the first audio renderer with respect to a first portion of the audio data to obtain one or more first speaker feeds; means for obtaining a second audio renderer of the plurality of audio renderers; means for applying the second audio renderer with respect to a second portion of the audio data to obtain one or more second speaker feeds; and means for outputting, to one or more speakers, the one or more first speaker feeds and the one or more second speaker feeds.

Clause 46A. The device of clause 45A, further comprising means for obtaining, from a bitstream representative of a compressed version of the audio data, one or more indications indicating that the first audio renderer is to be applied to the first portion of the audio data.

Clause 47A. The device of any combination of clauses 45A and 46A, further comprising means for obtaining, from a bitstream representative of a compressed version of the audio data, one or more indications indicating that the second audio renderer is to be applied to the second portion of the audio data.

Clause 48A. The device of any combination of clauses 45A-47A, further comprising means for obtaining, from a bitstream representative of a compressed version of the audio data, a first indication identifying the first audio render, wherein the means for obtaining the first audio renderer comprises means for obtaining, based on the first indication, the first audio renderer.

Clause 49A. The device of clause 48A, wherein the means for obtaining the first audio renderer comprises means for obtaining, based on the first indication and from the bitstream, the first audio renderer.

Clause 50A. The device of any combination of clauses 45A-49A, further comprising means for obtaining, from a bitstream representative of a compressed version of the audio data, a second indication identifying the second audio render, wherein the means for obtaining the second audio renderer comprises means for obtaining, based on the second indication, the second audio renderer.

Clause 51A. The device of clause 50A, wherein the means for obtaining the second audio renderer comprises means for obtaining, based on the second indication and from the bitstream, the second audio renderer.

Clause 52A. The device of any combination of clauses 45A-47A, further comprising means for obtaining, form a bitstream representative of a compressed version of the audio data, the audio data.

Clause 53A. The device of clause 52A, wherein the first portion of the audio data comprises a first transport channel of the bitstream that is representative of a compressed version of the first portion of the audio data.

Clause 54A. The device of any combination of clauses 52A and 53A, wherein the second portion of the audio data comprises a second transport channel of the bitstream that is representative of a compressed version of the second portion of the audio data.

Clause 55A. The device of any combination of clauses 53A and 54A, wherein the audio data comprises higher order ambisonic audio data, and wherein the first transport channel comprises a compressed version of a first ambient higher order ambisonic coefficient or a compressed version of a first predominant audio signal decomposed from the higher order ambisonic audio data.

Clause 56A. The device of any combination of clauses 53A-55A, wherein the audio data comprises higher order ambisonic audio data, and wherein the second transport channel comprises a compressed version of a second ambient higher order ambisonic coefficient or a compressed version of a second predominant audio signal decomposed from the higher order ambisonic audio data.

Clause 57A. The device of any combination of clauses 45A-56A, wherein the first portion of the audio data and the second portion of the audio data describe the soundfield at a concurrent period of time.

Clause 58A. The device of any combination of clauses 45A-56A, wherein the first portion of the higher order ambisonic audio data and the second portion of the higher order ambisonic audio data describe the soundfield at a same period of time.

Clause 59A. The device of any combination of clauses 45A-56A, wherein the means for applying the first audio renderer comprises means for applying the first audio renderer concurrent to applying the second audio renderer.

Clause 60A. The device of any combination of clauses 45A-59A, wherein the first portion of the audio data comprises first higher order ambisonic audio data obtained from first channel-based audio data through application of a channel-to-ambisonic renderer, and wherein the first audio renderer includes an ambisonic-to-channel renderer that operates reciprocally to the channel-to-ambisonic renderer.

Clause 61A. The device of any combination of clauses 45A-60A, wherein the first portion of the audio data comprises first higher order ambisonic audio data obtained from first object-based audio data through application of an object-to-ambisonic renderer, and wherein the second audio renderer includes an ambisonic-to-object renderer that operates reciprocally to the object-to-ambisonic renderer.

Clause 62A. The device of any combination of clauses 45A-61A, wherein the second portion of the audio data comprises second higher order ambisonic audio data obtained from second channel-based audio data through application of a channel-to-ambisonic renderer, and wherein the first audio renderer includes an ambisonic-to-channel renderer that operates reciprocally to the channel-to-ambisonic renderer.

Clause 63A. The device of any combination of clauses 45A-62A, wherein the second portion of the audio data comprises second higher order ambisonic audio data obtained from second object-based audio data through application of an object-to-ambisonic renderer, and wherein the second audio renderer includes an ambisonic-to-object renderer that operates reciprocally to the object-to-ambisonic renderer.

Clause 64A. The device of any combination of clauses 45A-63A, wherein one or more of the first portion of the audio data and the second portion of the audio data comprises higher order ambisonic audio data, and wherein one or more of the first audio renderer and the second audio renderer comprises an ambisonic-to-channel audio renderer.

Clause 65A. The device of any combination of clauses 45A-64A, wherein one or more of the first portion of the audio data and the second portion of the audio data comprises channel-based audio data, and wherein one or more of the first audio renderer and the second audio renderer comprises a downmix matrix.

Clause 66A. The device of any combination of clauses 45A-65A, wherein one or more of the first portion of the audio data and the second portion of the audio data comprises object-based audio data, and wherein one or more of the first audio renderer and the second audio renderer comprises vector based amplitude panning matrix.

Clause 67A. A non-transitory computer-readable storage medium having stored thereon instructions that, when executed, cause one or more processors to: obtain a first audio renderer of a plurality of audio renderers; apply the first audio renderer with respect to a first portion of audio data to obtain one or more first speaker feeds; obtain a second audio renderer of the plurality of audio renderers; apply the second audio renderer with respect to a second portion of the audio data to obtain one or more second speaker feeds; and output, to one or more speakers, the one or more first speaker feeds and the one or more second speaker feeds.

Clause 1B. A device configured to obtain a bitstream representative of audio data describing a soundfield, the device comprising: one or more memories configured to store the audio data; one or more processors configured to: specify, in the bitstream, a first indication identifying a first audio renderer of a plurality of audio renderers to be applied to a first portion of the audio data; specify, in the bitstream, the first portion of the audio data; specify, in the bitstream, a second indication identifying a second audio renderer of the plurality of audio renderers to be applied to a second portion of the audio data; specify, in the bitstream, the second portion of the audio data; and output the bitstream.

Clause 2B. The device of clause 1B, wherein the one or more processors are further configured to specify, in the bitstream, one or more indications indicating that the first audio renderer is to be applied to the first portion of the audio data.

Clause 3B. The device of any combination of clauses 1B and 2B, wherein the one or more processors are further configured to specify, in the bitstream, one or more indications indicating that the second audio renderer is to be applied to the second portion of the audio data.

Clause 4B. The device of any combination of clauses 1B-3B, wherein the first indication includes the first audio renderer.

Clause 5B. The device of any combination of clauses 1B-4B, wherein the second indication includes the second audio renderer.

Clause 6B. The device of any combination of clauses 1B-5B, wherein the first portion of the audio data comprises a first transport channel of the bitstream that is representative of a compressed version of the first portion of the audio data.

Clause 7B. The device of any combination of clauses 1B-6B, wherein the second portion of the audio data comprises a second transport channel of the bitstream that is representative of a compressed version of the second portion of the audio data.

Clause 8B. The device of any combination of clauses 6B and 7B, wherein the audio data comprises higher order ambisonic audio data, and wherein the first transport channel comprises a compressed version of a first ambient higher order ambisonic coefficient or a compressed version of a first predominant audio signal decomposed from the higher order ambisonic audio data.

Clause 9B. The device of any combination of clauses 6B-8B, wherein the audio data comprises higher order ambisonic audio data, and wherein the second transport channel comprises a compressed version of a second ambient higher order ambisonic coefficient or a compressed version of a second predominant audio signal decomposed from the higher order ambisonic audio data.

Clause 10B. The device of any combination of clauses 1B-9B, wherein the first portion of the audio data and the second portion of the audio data describe the soundfield at a concurrent period of time.

Clause 11B. The device of any combination of clauses 1B-10B, wherein the first portion of the higher order ambisonic audio data and the second portion of the higher order ambisonic audio data describe the soundfield at a same period of time.

Clause 12B. The device of any combination of clauses 1B-11B, wherein the first portion of the audio data comprises first higher order ambisonic audio data obtained from first channel-based audio data through application of a channel-to-ambisonic renderer, and wherein the first audio renderer includes an ambisonic-to-channel renderer that operates reciprocally to the channel-to-ambisonic renderer.

Clause 13B. The device of any combination of clauses 1B-12B, wherein the first portion of the audio data comprises first higher order ambisonic audio data obtained from first object-based audio data through application of an object-to-ambisonic renderer, and wherein the second audio renderer includes an ambisonic-to-object renderer that operates reciprocally to the object-to-ambisonic renderer.

Clause 14B. The device of any combination of clauses 1B-13B, wherein the second portion of the audio data comprises second higher order ambisonic audio data obtained from second channel-based audio data through application of a channel-to-ambisonic renderer, and wherein the first audio renderer includes an ambisonic-to-channel renderer that operates reciprocally to the channel-to-ambisonic renderer.

Clause 15B. The device of any combination of clauses 1B-14B, wherein the second portion of the audio data comprises second higher order ambisonic audio data obtained from second object-based audio data through application of an object-to-ambisonic renderer, and wherein the second audio renderer includes an ambisonic-to-object renderer that operates reciprocally to the object-to-ambisonic renderer.

Clause 16B. The device of any combination of clauses 1B-15B, wherein one or more of the first portion of the audio data and the second portion of the audio data comprises higher order ambisonic audio data, and wherein one or more of the first audio renderer and the second audio renderer comprises an ambisonic-to-channel audio renderer.

Clause 17B. The device of any combination of clauses 1B-16B, wherein one or more of the first portion of the audio data and the second portion of the audio data comprises channel-based audio data, and wherein one or more of the first audio renderer and the second audio renderer comprises a downmix matrix.

Clause 18B. The device of any combination of clauses 1B-17B, wherein one or more of the first portion of the audio data and the second portion of the audio data comprises object-based audio data, and wherein one or more of the first audio renderer and the second audio renderer comprises vector based amplitude panning matrix.

Clause 19B. A method of obtaining a bitstream representative of audio data describing a soundfield, the device comprising: specifying, in the bitstream, a first indication identifying a first audio renderer of a plurality of audio renderers to be applied to a first portion of the audio data; specifying, in the bitstream, the first portion of the audio data; specifying, in the bitstream, a second indication identifying a second audio renderer of the plurality of audio renderers to be applied to a second portion of the audio data; specifying, in the bitstream, the second portion of the audio data; and outputting the bitstream.

Clause 20B. The method of clause 19B, further comprising specifying, in the bitstream, one or more indications indicating that the first audio renderer is to be applied to the first portion of the audio data.

Clause 21B. The method of any combination of clauses 19B and 20B, further comprising specifying, in the bitstream, one or more indications indicating that the second audio renderer is to be applied to the second portion of the audio data.

Clause 22B. The method of any combination of clauses 19B-21B, wherein the first indication includes the first audio renderer.

Clause 23B. The method of any combination of clauses 19B-22B, wherein the second indication includes the second audio renderer.

Clause 24B. The method of any combination of clauses 19B-23B, wherein the first portion of the audio data comprises a first transport channel of the bitstream that is representative of a compressed version of the first portion of the audio data.

Clause 25B. The method of any combination of clauses 19B-24B, wherein the second portion of the audio data comprises a second transport channel of the bitstream that is representative of a compressed version of the second portion of the audio data.

Clause 26B. The method of any combination of clauses 24B and 25B, wherein the audio data comprises higher order ambisonic audio data, and wherein the first transport channel comprises a compressed version of a first ambient higher order ambisonic coefficient or a compressed version of a first predominant audio signal decomposed from the higher order ambisonic audio data.

Clause 27B. The method of any combination of clauses 24B-26B, wherein the audio data comprises higher order ambisonic audio data, and wherein the second transport channel comprises a compressed version of a second ambient higher order ambisonic coefficient or a compressed version of a second predominant audio signal decomposed from the higher order ambisonic audio data.

Clause 28B. The method of any combination of clauses 19B-27B, wherein the first portion of the audio data and the second portion of the audio data describe the soundfield at a concurrent period of time.

Clause 29B. The method of any combination of clauses 19B-28B, wherein the first portion of the higher order ambisonic audio data and the second portion of the higher order ambisonic audio data describe the soundfield at a same period of time.

Clause 30B. The method of any combination of clauses 19B-29B, wherein the first portion of the audio data comprises first higher order ambisonic audio data obtained from first channel-based audio data through application of a channel-to-ambisonic renderer, and wherein the first audio renderer includes an ambisonic-to-channel renderer that operates reciprocally to the channel-to-ambisonic renderer.

Clause 31B. The method of any combination of clauses 19B-30B, wherein the first portion of the audio data comprises first higher order ambisonic audio data obtained from first object-based audio data through application of an object-to-ambisonic renderer, and wherein the second audio renderer includes an ambisonic-to-object renderer that operates reciprocally to the object-to-ambisonic renderer.

Clause 32B. The method of any combination of clauses 19B-31B, wherein the second portion of the audio data comprises second higher order ambisonic audio data obtained from second channel-based audio data through application of a channel-to-ambisonic renderer, and wherein the first audio renderer includes an ambisonic-to-channel renderer that operates reciprocally to the channel-to-ambisonic renderer.

Clause 33B. The method of any combination of clauses 19B-32B, wherein the second portion of the audio data comprises second higher order ambisonic audio data obtained from second object-based audio data through application of an object-to-ambisonic renderer, and wherein the second audio renderer includes an ambisonic-to-object renderer that operates reciprocally to the object-to-ambisonic renderer.

Clause 34B. The method of any combination of clauses 19B-33B, wherein one or more of the first portion of the audio data and the second portion of the audio data comprises higher order ambisonic audio data, and wherein one or more of the first audio renderer and the second audio renderer comprises an ambisonic-to-channel audio renderer.

Clause 35B. The method of any combination of clauses 19B-34B, wherein one or more of the first portion of the audio data and the second portion of the audio data comprises channel-based audio data, and wherein one or more of the first audio renderer and the second audio renderer comprises a downmix matrix.

Clause 36B. The method of any combination of clauses 19B-35B, wherein one or more of the first portion of the audio data and the second portion of the audio data comprises object-based audio data, and wherein one or more of the first audio renderer and the second audio renderer comprises vector based amplitude panning matrix.

Clause 37B. A device configured to obtain a bitstream representative of audio data describing a soundfield, the device comprising: means for specifying, in the bitstream, a first indication identifying a first audio renderer of a plurality of audio renderers to be applied to a first portion of the audio data; means for specifying, in the bitstream, the first portion of the audio data; means for specifying, in the bitstream, a second indication identifying a second audio renderer of the plurality of audio renderers to be applied to a second portion of the audio data; means for specifying, in the bitstream, the second portion of the audio data; and means for outputting the bitstream.

Clause 38B. The device of clause 37B, further comprising means for specifying, in the bitstream, one or more indications indicating that the first audio renderer is to be applied to the first portion of the audio data.

Clause 39B. The device of any combination of clauses 37B and 38B, further comprising means for specifying, in the bitstream, one or more indications indicating that the second audio renderer is to be applied to the second portion of the audio data.

Clause 40B. The device of any combination of clauses 37B-39B, wherein the first indication includes the first audio renderer.

Clause 41B. The device of any combination of clauses 37B-40B, wherein the second indication includes the second audio renderer.

Clause 42B. The device of any combination of clauses 37B-41B, wherein the first portion of the audio data comprises a first transport channel of the bitstream that is representative of a compressed version of the first portion of the audio data.

Clause 43B. The device of any combination of clauses 37B-42B, wherein the second portion of the audio data comprises a second transport channel of the bitstream that is representative of a compressed version of the second portion of the audio data.

Clause 44B. The device of any combination of clauses 42B and 43B, wherein the audio data comprises higher order ambisonic audio data, and wherein the first transport channel comprises a compressed version of a first ambient higher order ambisonic coefficient or a compressed version of a first predominant audio signal decomposed from the higher order ambisonic audio data.

Clause 45B. The device of any combination of clauses 42B-44B, wherein the audio data comprises higher order ambisonic audio data, and wherein the second transport channel comprises a compressed version of a second ambient higher order ambisonic coefficient or a compressed version of a second predominant audio signal decomposed from the higher order ambisonic audio data.

Clause 46B. The device of any combination of clauses 37B-45B, wherein the first portion of the audio data and the second portion of the audio data describe the soundfield at a concurrent period of time.

Clause 47B. The device of any combination of clauses 37B-46B, wherein the first portion of the higher order ambisonic audio data and the second portion of the higher order ambisonic audio data describe the soundfield at a same period of time.

Clause 48B. The device of any combination of clauses 37B-47B, wherein the first portion of the audio data comprises first higher order ambisonic audio data obtained from first channel-based audio data through application of a channel-to-ambisonic renderer, and wherein the first audio renderer includes an ambisonic-to-channel renderer that operates reciprocally to the channel-to-ambisonic renderer.

Clause 49B. The device of any combination of clauses 37B-48B, wherein the first portion of the audio data comprises first higher order ambisonic audio data obtained from first object-based audio data through application of an object-to-ambisonic renderer, and wherein the second audio renderer includes an ambisonic-to-object renderer that operates reciprocally to the object-to-ambisonic renderer.

Clause 50B. The device of any combination of clauses 37B-49B, wherein the second portion of the audio data comprises second higher order ambisonic audio data obtained from second channel-based audio data through application of a channel-to-ambisonic renderer, and wherein the first audio renderer includes an ambisonic-to-channel renderer that operates reciprocally to the channel-to-ambisonic renderer.

Clause 51B. The device of any combination of clauses 37B-50B, wherein the second portion of the audio data comprises second higher order ambisonic audio data obtained from second object-based audio data through application of an object-to-ambisonic renderer, and wherein the second audio renderer includes an ambisonic-to-object renderer that operates reciprocally to the object-to-ambisonic renderer.

Clause 52B. The device of any combination of clauses 37B-51B, wherein one or more of the first portion of the audio data and the second portion of the audio data comprises higher order ambisonic audio data, and wherein one or more of the first audio renderer and the second audio renderer comprises an ambisonic-to-channel audio renderer.

Clause 53B. The device of any combination of clauses 37B-52B, wherein one or more of the first portion of the audio data and the second portion of the audio data comprises channel-based audio data, and wherein one or more of the first audio renderer and the second audio renderer comprises a downmix matrix.

Clause 54B. The device of any combination of clauses 37B-53B, wherein one or more of the first portion of the audio data and the second portion of the audio data comprises object-based audio data, and wherein one or more of the first audio renderer and the second audio renderer comprises vector based amplitude panning matrix.

Clause 55B. A non-transitory computer-readable storage medium having stored thereon instructions that, when executed, cause one or more processors to: specify, in a bitstream representative of a compressed version of audio data describing a soundfield, a first indication identifying a first audio renderer of a plurality of audio renderers to be applied to a first portion of the audio data; specify, in the bitstream, the first portion of the audio data; specify, in the bitstream, a second indication identifying a second audio renderer of the plurality of audio renderers to be applied to a second portion of the audio data; specify, in the bitstream, the second portion of the audio data; and output the bitstream.

Moreover, as used herein, "A and/or B" means "A or B", or both "A and B."

Various aspects of the techniques have been described. These and other aspects of the techniques are within the scope of the following claims.

The invention claimed is:

1. A device configured to render audio data representative of a soundfield, the device comprising:

one or more memories configured to store a plurality of audio renderers;

one or more processors configured to:

obtain a first audio renderer of the plurality of audio renderers;

apply the first audio renderer with respect to a first portion of the audio data to obtain one or more first speaker feeds;

obtain a second audio renderer of the plurality of audio renderers;

apply the second audio renderer with respect to a second portion of the audio data to obtain one or more second speaker feeds, wherein the first portion of the audio data and the second portion of the audio data describe the soundfield at a concurrent period of time; and output, to one or more speakers, the one or more first speaker feeds and the one or more second speaker feeds.

2. The device of claim 1, wherein the one or more processors are further configured to obtain, from a bitstream representative of a compressed version of the audio data, one or more indications indicating that the first audio renderer is to be applied to the first portion of the audio data.

3. The device of claim 1, wherein the one or more processors are further configured to obtain, from a bitstream representative of a compressed version of the audio data, one or more indications indicating that the second audio renderer is to be applied to the second portion of the audio data.

4. The device of claim 1, wherein the one or more processors are further configured to obtain, from a bitstream representative of a compressed version of the audio data, a first indication identifying the first audio render, and wherein the one or more processors are configured to obtain, based on the first indication, the first audio renderer.

5. The device of claim 4, wherein the one or more processors are configured to obtain, based on the first indication and from the bitstream, the first audio renderer.

6. The device of claim 1, wherein the one or more processors are further configured to obtain, from a bitstream representative of a compressed version of the audio data, a second indication identifying the second audio render, and wherein the one or more processors are configured to obtain, based on the second indication, the second audio renderer.

7. The device of claim 6, wherein the one or more processors are configured to obtain, based on the second indication and from the bitstream, the second audio renderer.

8. The device of claim 1, wherein the one or more processors are further configured to obtain, form a bitstream representative of a compressed version of the audio data, the audio data.

9. The device of claim 8, wherein the second portion of the audio data comprises a second transport channel of the bitstream that is representative of a compressed version of the second portion of the audio data.

10. The device of claim 8, wherein the first portion of the audio data comprises a first transport channel of the bitstream that is representative of a compressed version of the first portion of the audio data.

11. The device of claim 10, wherein the audio data comprises higher order ambisonic audio data, and wherein the first transport channel comprises a compressed version of a first ambient higher order ambisonic coefficient or a compressed version of a first predominant audio signal decomposed from the higher order ambisonic audio data.

12. The device of claim 10, wherein the audio data comprises higher order ambisonic audio data, and wherein the second transport channel comprises a compressed version of a second ambient higher order ambisonic coefficient or a compressed version of a second predominant audio signal decomposed from the higher order ambisonic audio data.

13. The device of claim 1, wherein the first portion of the audio data and the second portion of the audio data describe the soundfield at a same period of time.

14. The device of claim 1, wherein the one or more processors are configured to apply the first audio renderer concurrent to applying the second audio renderer.

15. The device of claim 1, wherein the first portion of the audio data comprises first higher order ambisonic audio data obtained from first channel-based audio data through application of a channel-to-ambisonic renderer, and wherein the first audio renderer includes an ambisonic-to-channel renderer that operates reciprocally to the channel-to-ambisonic renderer.

16. The device of claim 1, wherein the first portion of the audio data comprises first higher order ambisonic audio data obtained from first object-based audio data through application of an object-to-ambisonic renderer, and wherein the second audio renderer includes an ambisonic-to-object renderer that operates reciprocally to the object-to-ambisonic renderer.

17. The device of claim 1, wherein the second portion of the audio data comprises second higher order ambisonic audio data obtained from second channel-based audio data through application of a channel-to-ambisonic renderer, and wherein the first audio renderer includes an ambisonic-to-channel renderer that operates reciprocally to the channel-to-ambisonic renderer.

18. The device of claim 1, wherein the second portion of the audio data comprises second higher order ambisonic audio data obtained from second object-based audio data through application of an object-to-ambisonic renderer, and wherein the second audio renderer includes an ambisonic-to-object renderer that operates reciprocally to the object-to-ambisonic renderer.

19. The device of claim 1, wherein one or more of the first portion of the audio data and the second portion of the audio data comprises higher order ambisonic audio data, and wherein one or more of the first audio renderer and the second audio renderer comprises an ambisonic-to-channel audio renderer.

20. The device of claim 1, wherein one or more of the first portion of the audio data and the second portion of the audio data comprises channel-based audio data, and wherein one or more of the first audio renderer and the second audio renderer comprises a downmix matrix.

21. The device of claim 1, wherein one or more of the first portion of the audio data and the second portion of the audio data comprises object-based audio data, and wherein one or more of the first audio renderer and the second audio renderer comprises vector-based amplitude panning matrix.

22. A method of rendering audio data representative of a soundfield, the device comprising:

obtaining a first audio renderer of a plurality of audio renderers;

applying the first audio renderer with respect to a first portion of the audio data to obtain one or more first speaker feeds;

obtaining a second audio renderer of the plurality of audio renderers;

applying the second audio renderer with respect to a second portion of the audio data to obtain one or more second speaker feeds, wherein the first portion of the audio data and the second portion of the audio data describe the soundfield at a concurrent period of time; and outputting, to one or more speakers, the one or more first speaker feeds and the one or more second speaker feeds.

23. The method of claim 22, further comprising obtaining, from a bitstream representative of a compressed version of the audio data, one or more indications indicating that the first audio renderer is to be applied to the first portion of the audio data.

24. The method of claim 22, further comprising obtaining, from a bitstream representative of a compressed version of the audio data, one or more indications indicating that the second audio renderer is to be applied to the second portion of the audio data.

25. The method of claim 22, further comprising obtaining, from a bitstream representative of a compressed version of the audio data, a first indication identifying the first audio render, wherein obtaining the first audio renderer comprises obtaining, based on the first indication, the first audio renderer.

26. The method of claim 25, wherein obtaining the first audio renderer comprises obtaining, based on the first indication and from the bitstream, the first audio renderer.

27. The method of claim 22, further comprising obtaining, from a bitstream representative of a compressed version of the audio data, a second indication identifying the second audio render, wherein obtaining the second audio renderer comprises obtaining, based on the second indication, the second audio renderer.

28. A device configured to obtain a bitstream representative of audio data describing a soundfield, the device comprising:

one or more memories configured to store the audio data;

one or more processors configured to:

specify, in the bitstream, a first indication identifying a first audio renderer of a plurality of audio renderers to be applied to a first portion of the audio data;

specify, in the bitstream, the first portion of the audio data;

specify, in the bitstream, a second indication identifying a second audio renderer of the plurality of audio renderers to be applied to a second portion of the audio data;

specify, in the bitstream, the second portion of the audio data, wherein the first portion of the audio data and the second portion of the audio data describe the soundfield at a concurrent period of time; and output the bitstream.

29. A method of obtaining a bitstream representative of audio data describing a soundfield, the device comprising:

specifying, in the bitstream, a first indication identifying a first audio renderer of a plurality of audio renderers to be applied to a first portion of the audio data;

specifying, in the bitstream, the first portion of the audio data;

specifying, in the bitstream, a second indication identifying a second audio renderer of the plurality of audio renderers to be applied to a second portion of the audio data;

specifying, in the bitstream, the second portion of the audio data, wherein the first portion of the audio data and the second portion of the audio data describe the soundfield at a concurrent period of time; and outputting the bitstream.

* * * * *